US006733959B2

(12) United States Patent
Gysling et al.

(10) Patent No.: US 6,733,959 B2
(45) **Date of Patent: *May 11, 2004**

(54) CHEMICALLY SENSITIZED AQUEOUS-BASED PHOTOTHERMOGRAPHIC EMULSIONS AND MATERIALS AND METHODS OF USING SAME

(75) Inventors: Henry J. Gysling, Rochester, NY (US); David A. Dickinson, Brockport, NY (US); Mark Lelental, Rochester, NY (US); John W. Boettcher, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/923,039

(22) Filed: Aug. 6, 2001

(65) Prior Publication Data

US 2003/0073026 A1 Apr. 17, 2003

(51) Int. Cl.[7] ..... G03C 1/498; G03C 1/09

(52) U.S. Cl. ..... 430/350; 430/600; 430/603; 430/607; 430/611; 430/613; 430/614; 430/619; 430/944; 430/964

(58) Field of Search ..... 430/619, 600, 430/614, 607, 350, 611, 603, 613, 522, 964, 944

(56) References Cited

U.S. PATENT DOCUMENTS

| | | | | |
|---|---|---|---|---|
| 3,655,394 | A | 4/1972 | Illingsworth | |
| 4,036,650 | A | 7/1977 | Hasegawa et al. | |
| 4,113,496 | A | 9/1978 | Shiga et al. | |
| 4,144,062 | A | 3/1979 | Lelental et al. | |
| 4,188,218 | A | 2/1980 | Gysling | |
| 4,251,623 | A | 2/1981 | Gysling | |
| 4,639,414 | A | 1/1987 | Sakaguchi | |
| 5,273,874 | A | 12/1993 | Kojima et al. | |
| 5,459,027 | A | 10/1995 | Takada et al. | |
| 5,498,511 | A | 3/1996 | Yamashita et al. | |
| 5,677,120 | A | 10/1997 | Lushington et al. | |
| 5,759,760 | A | 6/1998 | Lushingto et al. | |
| 5,763,154 | A | 6/1998 | Gysling et al. | |
| 5,922,529 | A | 7/1999 | Tsuzuki et al. | |
| 5,968,725 | A | 10/1999 | Katoh et al. | |
| 6,025,122 | A | 2/2000 | Sakai et al. | |
| 6,100,022 | A | 8/2000 | Inoue et al. | |
| 6,187,528 | B1 * | 2/2001 | Uytterhoeven et al. | 430/619 |
| 6,423,481 | B1 | 7/2002 | Simpson et al. | |
| 2001/0029001 | A1 * | 10/2001 | Lelental et al. | 430/619 |
| 2001/0031436 | A1 * | 10/2001 | Lelental et al. | 430/619 |

FOREIGN PATENT DOCUMENTS

| | | |
|---|---|---|
| EP | 1070986 A1 | 1/2001 |
| JP | 57817/53 | 5/1978 |
| JP | 56-19618 | 5/1981 |
| JP | 9-43766 | 2/1997 |
| WO | WO 02/067053 A2 | 8/2002 |

OTHER PUBLICATIONS

JP Abstract 53143216.
JP Abstract 53142222.
JP Abstract 52064925.
JP Abstract 9–311407.
JP Abstract 9–297370.
JP Abstract 11–352627.
JP Abstract 51–85721.
"Research Disclosure", Item 16655, Feb. 1978, Lelental & Gysling.
US 09/536,181, "Thermographic Imaging Elements and Processes For Their Use", Mar. 27, 2000 by Lelental et al (D–77015P).
US 09/746,400 "High Speed Photothermographic Materials Containing Tellurium Compounds And Methods Of Using Same", 12/21/0 by Lynch et al(D–80836).

* cited by examiner

*Primary Examiner*—Thorl Chea
(74) *Attorney, Agent, or Firm*—J. Lanny Tucker

(57) ABSTRACT

Photothermographic materials prepared using aqueous formulations include silver halides that are chemically sensitized using certain tellurium-containing compounds. Such tellurium-containing chemical sensitizing compounds are generally provided in aqueous solution or in an aqueous solid particulate dispersion and can be represented by the following Structure I, II, or III:

(I)

$$Te(L)_m(X^1)_n \quad \text{(II)}$$

$$Pd(X^2)_2[Te(R')_2]_2 \quad \text{(III)}$$

wherein X represents the same or different COR, CSR, $CNRR_a$, CR, $PRR_a$, or $P(OR)_2$ groups, R and $R_a$ are independently alkyl, alkenyl, or aryl groups, L is a ligand derived from a neutral Lewis base, $X^1$ and $X^2$ independently represent a halo, OCN, SCN, $S_2CNRR_a$, $S_2COR$, $S_2CSR$ $S_2P(OR)_2$, $S_2PRR_a$, SeCN, TeCN, CN, SR, OR, alkyl, aryl, $N_3$, or $O_2CR$ group, R' is an alkyl or aryl group, p is 2 or 4, m is 0, 1, 2, or 4, and n is 2 or 4 provided that when m is 0 or 2, n is 2 or 4, and when m is 1 or 4, n is 2.

37 Claims, No Drawings

CHEMICALLY SENSITIZED AQUEOUS-BASED PHOTOTHERMOGRAPHIC EMULSIONS AND MATERIALS AND METHODS OF USING SAME

FIELD OF THE INVENTION

This invention relates to thermally-developable imaging materials such as photothermographic materials. In particular, this invention relates to the use of certain tellurium-containing compounds as chemical sensitizers in photothermographic materials that are made using aqueous-based formulations. This invention also relates to methods of imaging using these photothermographic materials, and to methods of making them.

BACKGROUND OF THE INVENTION

Photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet or infrared radiation) and developed by the use of thermal energy. These materials, also known as "dry silver" materials if they contain silver image-forming components, generally comprise a support having coated thereon: (a) photocatalyst (such as silver halide) that upon such exposure provides a latent image in exposed grains that is capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photocatalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms, $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms [Klosterboer, Neblette's Eighth Edition: *Imaging Processes and Materials*, Sturge, Walworth & Shepp (Eds.), Van Nostrand-Reinhold, New York, Chapter 9, pages 279–291, 1989]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide, have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi,* 1994, 11, 992–997, and FR 2,254,047 (Robillard)].

The photosensitive silver halide may be made "in situ," for example, by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. Alternatively, a portion of the reducible silver ions can be completely converted to silver halide, and that portion can be added back to the source of reducible silver ions (see Usanov et al., International Conference on Imaging Science, 7–11 September 1998).

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to, and be present during, the formation of the source of reducible silver ions. Co-precipitation of the silver halide and the source of reducible silver ions provides a more intimate mixture of the two materials [see for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms, $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver containing-clusters of the latent image. This produces a black-and-white image. The non-photosensitive silver source is catalytically reduced to form the visible black-and-white negative image while the silver halide in the non-exposed areas, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate) is used to generate the visible image using thermal development. Thus imaged, the photosensitive silver halide serves as a photocatalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography", the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further post-processing imaging and development. In contrast, silver halide is removed from conventional photographic materials after solution development to prevent further imaging (that is, in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, dopants, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pages 74–75, and in Zou et al., *J. Imaging Sci. Technol.* 1996, 40, pages 94–103.

Problem to be Solved

One of the challenges in the use of photothermographic materials is attaining sufficient photothermographic speed in such materials that are also compatible with conventional imaging sources.

Each of the pure photographic silver halides (silver chloride, silver bromide and silver iodide) has its own natural response to radiation, in both wavelength and speed, within the UV, near UV and blue regions of the electromagnetic spectrum. Mixtures of silver halides (for example, silver bromochloroiodide, silver chloroiodide, silver chlorobromide and silver iodobromide) also have their own natural sensitivities within the UV and blue regions of the electromagnetic spectrum. Thus, silver halide grains, when composed of only silver and halogen atoms have defined levels of sensitivity depending upon the levels of specific halogen, crystal morphology (shape and structure of the crystals or grains) and other characteristics such as, for example, crystal defects, stresses, and dislocations, and dopants incorporated within or on the crystal lattice of the silver halide. These features may or may not have been controlled or purposely introduced to affect emulsion sensitometry.

The efforts to influence silver halide grain speed in conventional wet-processed silver halide emulsions generally fall within the investigation of crystal composition, morphology or structure (all briefly described above), or the use of dopants, spectral sensitizers, supersensitizers, reduction sensitizers, and chemical sensitizers (particularly sulfur sensitizers).

Chemical sensitization is a process, during or after silver halide crystal formation, in which sensitization centers [for example, silver sulfide clusters such as $(Ag_2S)_n$] are introduced onto the individual silver halide grains. For example, silver sulfide specks can be introduced by direct reaction of sulfur-contributing compounds with the silver halide during various stages or after completion of silver halide grain growth. These specks usually function as shallow electron traps for the preferential formation of a latent image center. Other chalcogens (Se and Te) can function similarly. The presence of these specks increases the speed or sensitivity of the resulting silver halide grains to radiation. Sulfur-contributing compounds useful for this purpose are described for example, by Sheppard et al., *J. Franklin Inst.,* 1923, 196, 653 and 673, C. E. K. Mees and T. H. James, *The Theory of the Photographic Process,* $4^{th}$ Edition, 1977, pages 152–3, and T. Tani, *Photographic Sensitivity: Theory and Mechanisms*, Oxford University Press, NY, 1995, p. 167–176.

Another useful class of chemical sensitizers includes tetrasubstituted thioureas as described in U.S. Pat. No. 6,368,779 (Lynch et al.) These compounds are thioureas in which the nitrogen atoms are fully substituted with various substituents.

Still another useful class of chemical sensitizers includes various tellurium-containing compounds, such as the compounds described in copending U.S. Ser. No. 09/746,400 (filed Dec. 21, 2000 by Lynch, Opatz, Shor, Simpson, Willett, and Gysling).

In addition, sulfur-containing and tellurium-containing chemical sensitizers can be used in combination with each other and/or in combination with various gold(I) and gold (III)-containing chemical sensitizing compounds as described for example in U.S. Pat. No. 6,100,022 (Inoue et al.) and U.S. Pat. No. 6,423,481 (Simpson et al.).

Tellurium chemical sensitization of photothermographic materials has also been reported in U.S. Pat. No. 6,025,122 (Sakai et al.) that describes the use of conventional tellurides such as dibenzoyl ditelluride, and other tellurium compounds as chemical sensitizers. Similar disclosure is provided in U.S. Pat. No. 5,968,725 (Katoh et al.). It is also known to use dibenzoyl ditelluride in combination with other chemical sensitizers such as sodium thiosulfate, triphenylphosphine selenides [such as, pentafluorophenyldiphenyl phosphine selenide or bis(pentafluorophenyl)phenyl phosphine selenide] and chloroauric acid in thermally-developable materials.

*Research Disclosure*, Vol. 166, pages 54–56, 1978 describes the use of organotellurium compounds in thermally-developable materials, but these compounds are used to form the image, not to sensitize silver halide.

The use of sodium thiosulfate, triarylphosphine selenides and dibenzoyl ditelluride, or mixtures thereof, as chemical sensitizers for photothermographic materials is also known. For example, U.S. Pat. No. 4,639,414 (Sakaguchi) describes the use of sodium thiosulfate to decrease fog and loss of sensitivity upon storage in a silver benzotriazole, gelatin-based photothermographic emulsion. The light-sensitive silver halide is said to be chemically sensitized in the presence of a sensitizing dye that is added after the formation of silver halide but before the completion of chemical sensitization.

The photothermographic materials that generally include known tellurium-containing chemical sensitizing compounds are most often prepared using non-aqueous solvents and formulations. Thus, most of such chemical sensitizing compounds are typically water-insoluble and not necessarily useful in aqueous formulations.

Aqueous-based photothermographic materials offer several important advantages in manufacture. With the reduction or elimination of organic solvents for emulsion formulation, the impact on the environment is reduced. In addition, there are advantages to formulating silver halide in aqueous dispersions by providing greater control in the manufacturing process.

Photothermographic materials are constantly being redesigned to meet ever-increasing performance, storage, and manufacturing demands raised by customers, regulators, and manufacturers. One of these demands is increased photospeed without a significant increase in fog ($D_{min}$) or a loss in $D_{max}$. It would further be desirable to achieve improved sensitometric properties in aqueous-based photothermographic materials.

SUMMARY OF THE INVENTION

The present invention relates to our discovery that the use of certain tellurium compounds as chemical sensitizers provides aqueous-based photothermographic materials having increased photospeed without a significant increase in $D_{min}$.

The present invention provides the desired benefits with a photothermographic material comprising a support having thereon one or more layers comprising a hydrophilic binder and in reactive association:

a. a photocatalyst, b. a non-photosensitive source of reducible silver ions that is present as an aqueous colloidal dispersion, c. a reducing composition for the reducible silver ions, and d. a tellurium-containing chemical sensitizing compound represented by the following Structure I, II, or III:

(I)

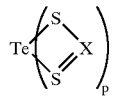

$$Te(L)_m(X^1)_n \quad (II)$$

$$Pd(X^2)_2[Te(R')_2]_2 \quad (III)$$

wherein X represents the same or different COR, CSR, $CNRR_a$, CR, $PRR_a$, or $P(OR)_2$ groups, R and $R_a$ are independently alkyl, alkenyl, or aryl groups, L is a ligand derived from a neutral Lewis base, $X^1$ and $X^2$ independently represent halo, OCN, SCN, $S_2CNRR_a$, $S_2COR$, $S_2CSR$ $S_2P(OR)_2$, $S_2PRR_a$, SeCN, TeCN, CN, SR, OR, $N_3$, alkyl, aryl, or $O_2CR$ groups, R' is an alkyl or aryl group, p is 2 or 4, m is 0, 1, 2, or 4, and n is 2 or 4 provided that when m is 0 or 2, n is 2 or 4, and when m is 1 or 4, n is 2.

In preferred embodiments, one or more thiourea ligands useful in the tellurium compounds (for example, L in Structure II) are derived from compounds represented by the following Structure IV, V, or VI:

(IV)

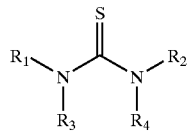

(V)

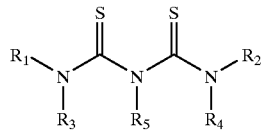

(VI)

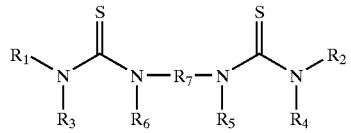

wherein:

in Structure IV, $R_1$, $R_2$, $R_3$ and $R_4$ are independently hydrogen, alkyl, cycloalkyl, alkenyl, alkynyl, aryl or heterocyclic groups, or R, and $R_2$ taken together, $R_3$ and $R_4$ taken together, $R_1$ and $R_3$ taken together or $R_2$ and $R_4$ taken together, can form a 5- to 7-membered heterocyclic ring, and in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

Further, a method of this invention for forming a visible image comprises:

A) imagewise exposing the photothermographic material described above to electromagnetic radiation to form a latent image, and B) simultaneously or sequentially, heating the exposed photothermographic material to develop the latent image into a visible image.

In some embodiments of this invention to provide an image, the photothermographic material has a transparent support and the imaging method of this invention further includes:

C) positioning the exposed and heat-developed photothermographic material with a visible image therein between a source of imaging radiation and an imageable material that is sensitive to the imaging radiation, and D) thereafter exposing the imageable material to the imaging radiation through the visible image in the exposed and heat-developed photothermographic material to provide a visible image in the imageable material.

In still another embodiment of this invention, a method for preparing a photothermographic emulsion comprises:

A) providing a photothermographic emulsion comprising silver halide grains and an aqueous colloidal dispersion of a non-photosensitive source of reducible silver ions, and B) positioning one or more of the tellurium-containing chemical sensitizers represented by Structures I, II, or III noted above, on or around the silver halide grains, the tellurium-containing chemical sensitizing compound being provided in an aqueous solution or a solid particulate dispersion.

Moreover, another method of preparing a photothermographic emulsion comprises:

A) providing silver halide grains,

B) providing a photothermographic emulsion of the silver halide grains and an aqueous colloidal dispersion of a non-photosensitive source of reducible silver ions, and C) prior to, during or immediately following either or both of steps A and B, chemically sensitizing the silver halide grains with a tellurium-containing chemical sensitizer represented by Structure I, II, or III as noted above, the tellurium-containing chemical sensitizing compound being provided in an aqueous solution or a solid particulate dispersion.

The tellurium-containing speed increasing compounds described for use in the photothermographic materials of this invention have a number of useful properties. For example, they can easily be prepared in good yields as air stable solids and are resistant to hydrolysis. Moreover, they can be formulated in aqueous dispersions to provide aqueous-based formulations in combination with nanoparticulate dispersions of non-photosensitive sources of reducible silver ions (described below). Thus, tellurium-containing compounds that generally have a low solubility in water or organic solvents (that is 50 mg/100 ml or less) can be provided in aqueous-based formulations in a convenient fashion.

The tellurium-containing chemical sensitizing compounds described herein provide increased photographic speed enhancement while maintaining high $D_{max}$ and low $D_{min}$, post processing stability, contrast, and raw stock keeping.

DETAILED DESCRIPTION OF THE INVENTION

The photothermographic materials of this invention can be used, for example, in conventional black-and-white photothermography, in electronically generated black-and-white hardcopy recording. They can be used in microfilm applications and in radiographic imaging (for example analog or digital medical imaging) and industrial radiography. They can also be used in the graphic arts area (for example, imagesetting and phototypesetting), in the manufacture of printing plates, and in proofing. Furthermore, the absorbance of these photothermographic materials between 350 and 450 nm is sufficiently low (less than 0.5) to permit their use in graphic arts applications such as contact printing, proofing, and duplicating ("duping"). The photothermographic materials of this invention are preferably used to obtain black-and-white images.

In the photothermographic materials of this invention, the components needed for imaging can be in one or more layers. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity (or reactive association) and preferably are in the same layer.

Various layers are usually disposed on the "backside" (non-emulsion side) of the materials, including antihalation layer(s), protective layers, antistatic layers, conducting layers and transport enabling layers.

Various layers are also usually disposed on the "frontside" or emulsion side of the support, including protective topcoat layers, primer layers, interlayers, opacifying layers, antistatic layers, antihalation layers, acutance layers, auxiliary layers and others readily apparent to one skilled in the art.

The present invention also provides a process for the formation of a visible image (usually a black-and-white image) by first exposing to electromagnetic radiation and thereafter heating the inventive photothermographic material. In one embodiment, the present invention provides a process comprising:

A) imagewise exposing the photothermographic material of this invention to electromagnetic radiation to which the photocatalyst (for example, a photosensitive silver halide) of the material is sensitive, to generate a latent image, and B) simultaneously or sequentially, heating the exposed material to develop the latent image into a visible image.

This visible image can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the exposed and heat-developed photothermographic material of this invention using steps C) and D) noted above.

When the photothermographic materials of this invention are heat-developed, as described below, a silver image (preferably a black-and-white silver image) is obtained. The photothermographic material may be exposed in step A using X-radiation, ultraviolet, visible, infrared or laser radiation using an infrared or visible laser, a gas laser, a laser diode, an infrared laser diode, a light-emitting screen, CRT tube, a light-emitting diode, or other light or radiation source readily apparent to one skilled in the art.

Definitions

As used herein:

In the descriptions of the photothermographic materials of the present invention, "a" or "an" component refers to "at least one" of that component. For example, the tellurium-containing chemical sensitizing compounds described herein can be used individually or in mixtures.

Heating in a substantially water-free condition as used herein, means heating at a temperature of from about 50° to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, page 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer," "imaging layer," or "photothermographic emulsion layer," means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential components and/or desirable additives. These layers are usually on what is known as the "frontside" of the support.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 750 nm.

"Short wavelength visible region of the spectrum" refers to that region of the spectrum from about 400 nm to about 450 nm.

"Red region of the spectrum" refers to that region of the spectrum of from about 600 nm to about 750 nm.

"Infrared region of the spectrum" refers to that region of the spectrum of from about 750 nm to about 1400 nm.

"Non-photosensitive" means not intentionally light sensitive.

"Transparent" means capable of transmitting visible light or imaging radiation without appreciable scattering or absorption.

As is well understood in this area, for the tellurium-containing compounds defined herein, substitution is not only tolerated, but is often advisable and various substituents are anticipated on the compounds used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy and the like. For example, alkyl group includes ether and thioether groups (for example, $CH_3—CH_2—CH_2—O—CH_2—$ or $CH_3—CH_2—CH_2—S—CH_2—$), haloalkyl, nitroalkyl, carboxyalkyl, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* and *Product Licensing Index* are publications of Kenneth Mason Publications Ltd., Dudley House, 12 North Street, Emsworth, Hampshire PO10 7DQ England (also available from Emsworth Design Inc., 147 West 24th Street, New York, N. Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide and others readily apparent to one skilled in the art. Mixtures of silver halides can also be used in any suitable proportion. Silver bromide and silver bromoiodide are more preferred, with the latter silver halide having up to 10 mol % silver iodide.

The shape of the photosensitive silver halide grains used in the present invention is in no way limited. The silver halide grains may have any crystalline habit including, but not limited to, cubic, octahedral, tetrahedral, orthorhombic, tabular, laminar, twinned, and platelet morphologies. If desired, a mixture of these crystals may be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example, in U.S.

Pat. No. 5,382,504 (Shor et al.). Iridium and/or copper doped core-shell and non-core-shell grains are described in U.S. Pat. No. 5,434,043 (Zou et al.) and U.S. Pat. No. 5,939,249 (Zou), incorporated herein by reference.

The photosensitive silver halide can be added to (or formed within) the emulsion layer(s) in any fashion as long as it is placed in catalytic proximity to the non-photosensitive source of reducible silver ions.

Generally, the photosensitive silver halide(s) is provided in the form of a hydrophilic photosensitive silver halide emulsion containing one or more peptizers (such as gelatin). A typical concentration of silver halide in the coated formulation is from about 0.01 to about 1 mol of photosensitive silver halide per mol of non-photosensitive source of reducible silver ions.

The hydrophilic silver halide emulsion containing a peptizer can be prepared using any conventional method in the photographic art, including those described in Product Licensing Index, Vol. 92, December 1971. The photographic silver halide, as described, can be washed or unwashed, and chemically sensitized as described below. By "hydrophilic photosensitive silver halide emulsion" is meant that it contains one or more peptizers that are compatible with an aqueous solvent.

Useful peptizers include, but are not limited to, gelatino peptizers known in the photographic art such as phthalated and non-phthalated gelatin, acid or base hydroylzed gelatins, and poly(vinyl alcohol). A particularly preferred peptizer is a cationic starch as taught in U.S. Pat. No. 5,604,085 (Maskasky), U.S. Pat. No. 5,620,840 (Maskasky), U.S. Pat. No. 5,667,955 (Maskasky), and U.S. Pat. No. 5,733,718 (Maskasky). Such peptizers appear to reduce fog and improve raw stock keeping.

The amount of peptizer in the hydrophilic silver halide emulsion is generally from about 5 to about 40 grams of peptizer per mole of silver. An especially useful concentration of peptizer is from about 9 to about 15 g of peptizer per mol of silver.

Hydrophilic binders are also preferably present in the silver halide formulation or emulsion. Useful binders including those conventionally used in the preparation of silver halide emulsions for photography and can be same or different as the peptizer. Gelatins, polyacrylamides, polymethacrylates, poly(vinyl alcohol) and starches are preferred. Poly(vinyl alcohol) is a more preferred binder in the aqueous silver halide emulsion.

The pH of the hydrophilic silver halide emulsion is generally maintained at from about 5 to about 6.2 during the emulsion precipitation step. The temperature of the reaction vessel within which the silver halide emulsion is prepared is prepared is typically maintained within a temperature range of about 35° C. to about 75° C. during the composition preparation. The temperature range and duration of the preparation can be altered to produce the desired emulsion grain size and desired composition properties. The silver halide emulsion can be prepared by means of emulsion preparation techniques and apparatus known in the photographic art. An especially useful method for preparation of the photothermographic composition is by simultaneous double-jet emulsion precipitation techniques.

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.1 $\mu$m. Those of ordinary skill in the art understand that there is a finite lower practical limit for silver halide grains that is partially dependent upon the wavelengths to which the grains are spectrally sensitized. Such a lower limit, for example, is typically about 0.01 to 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. Kenneth Mees and T. H. James, *The Theory of the Photographic Process*, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

It is also effective to have a portion of the silver halide be prepared in situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm), U.S. Pat. No. 4,076,539 (Ikenoue et al.), U.S. Pat. No. 3,457,075 (Morgan et al.) and J P Applications 13224/74, 42529/76 and 17216/75.

The one or more light-sensitive silver halides used in the photothermographic materials of the present invention are preferably present in an amount of from about 0.005 to about 0.5 mole, more preferably from about 0.01 to about 0.25 mole per mole, and most preferably from about 0.03 to about 0.15 mole, per mole of non-photosensitive source of reducible silver ions.

The advantages of this invention are provided by chemically sensitizing the silver halide(s) with certain speed increasing tellurium-containing compounds. Thus, these tellurium-containing compounds can be used effectively as chemical sensitizers. They can be represented by the following Structure I, II, or III:

(I)

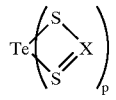

$$Te(L)_m(X^1)_n \quad \text{(II)}$$

$$Pd(X^2)_2[Te(R^t)_2]_2 \quad \text{(III).}$$

In Structure I, X represents the same or different COR, CSR, $CNRR_a$, CR, $PRR_a$ or $P(OR)_2$ groups that are attached to the two sulfur atoms through the noted carbon or phosphorus atom in the groups. Thus, when p is 2, there can be 2 of the same or different X groups. When p is 4, there can be 4 of the same X groups, or 2, 3, or 4 different X groups in the molecule. Preferably, X represents the same or different COR, CSR or $CNRR_a$, $PRR_a$ or $P(OR)_2$ groups, and more preferably X represents the same or different $CNRR_a$ groups.

The "R" and "$R_a$" groups used to define "X" can be independently any suitable substituted or unsubstituted alkyl group having 1 to 20 carbon atoms (including all possible isomers, such as methyl, ethyl, isopropyl, t-butyl, octyl, decyl, trimethylsilylmethyl, and 3-trimethylsilyl-n-propyl), substituted or unsubstituted alkenyl group having 2 to 20 carbon atoms (including all possible isomers such as ethenyl, 1-propenyl, and 2-propenyl) or substituted or unsubstituted carbocyclic or heterocyclic aryl group (Ar) having 6 to 10 carbon atoms in the single- or fused-ring system (such as phenyl, 4-methylphenyl, anthryl, naphthyl, xylyl, mesityl, indenyl, 2,4,6-tri(t-butyl)phenyl, pentafluorophenyl, p-methoxyphenyl, 3,5-dimethylphenyl, p-tolyl, piyridyl, and 2-phenylethyl). Preferably, R and $R_a$ are independently substituted or unsubstituted alkyl groups having 1 to 8 carbon atoms such as trimethylsilylmethyl, 3-trimethylsilyl-n-propyl, and 2-phenylethyl. Most preferably, R and $R_a$ are the same substituted or unsubstituted alkyl groups.

As noted above, in Structure I, p is 2 or 4, and preferably it is 2.

In Structure II, L represents the same or different neutral Lewis base ligands, such as ligands derived from thiourea, substituted thiourea, pyridine, and substituted pyridines. Preferably, L is a ligand derived from thiourea or a substituted thiourea, and more preferably, it is a ligand derived from a substituted thiourea as defined below in Structure IV, V, or VI.

$X^1$ represents a halo (such as chloro, bromo, or iodo), OCN, SCN, $S_2CNRR_a$, $S_2COR$, $S_2CSR$ $S_2P(OR)_2$, $S_2PRR_a$, SeCN, TeCN, CN, SR, $S_2CNR_2$, OR, $N_3$, alkyl (as defined above for R and $R_b$), aryl (as defined above for Ar), or $O_2CR$ group wherein R and $R_a$ are as defined above. Preferably, $X^1$ represents a halo (such as chloro or bromo), SCN, or $S_2CNRR_a$ group, and more preferably, it represents a halo group such as chloro or bromo.

Also, in Structure II, m is an integer selected from the group of integers of 0, 1, 2, and 4, and n is an integer of 2 or 4. However, when m is 0 or 2, n is 2 or 4, and when m is 1 or 4, n is 2. Preferably, m is 2 and n is 2 or 4.

In Structure III, $X^2$ represents a halo, OCN, SCN, $S_2CNRR_a$, $S_2COR$, $S_2CSR$ $S_2P(OR)_2$, $S_2PRR_a$, SeCN, TeCN, CN, SR, OR, alkyl (as defined for R), aryl (as defined above for Ar), $N_3$, or $O_2CR$ group in which R is as defined above. Preferably, $X^2$ represents a halo, SCN, or SeCN group. More preferably, $X^2$ is a chloro, bromo, or SCN group.

In addition, R' represents a substituted or unsubstituted alkyl or aryl group that is defined as described above for R. Preferably, R' is a substituted or unsubstituted alkyl group having from 1 to 10 carbon atoms.

Preferred thiourea ligands are derived from compounds represented below by Structure IV, V, or VI:

(IV)

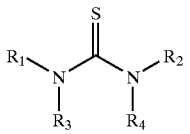

(V)

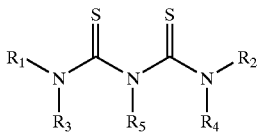

-continued (VI)

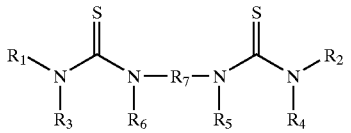

In Structure IV, $R_1$, $R_2$, $R_3$, and $R_4$ independently represent hydrogen, substituted or unsubstituted alkyl groups (including alkylenearyl groups such as benzyl), substituted or unsubstituted aryl groups (including arylenealkyl groups), substituted or unsubstituted cycloalkyl groups, substituted or unsubstituted alkenyl groups, substituted or unsubstituted alkynyl groups and heterocyclic groups.

Useful alkyl groups are branched or linear and can have from 1 to 20 carbon atoms (preferably having 1 to 5 carbon atoms), useful aryl groups can have from 6 to 14 carbon atoms in the carbocyclic ring, useful cycloalkyl groups can have from 5 to 14 carbon atoms in the central ring system, useful alkenyl and alkynyl groups can be branched or linear and have 2 to 20 carbon atoms, and useful heterocyclic groups can have 5 to 10 carbon, oxygen, sulfur and nitrogen atoms in the central ring system (they can also have fused rings).

These various monovalent groups can be further substituted with one or more groups including but not limited to, halo groups, alkoxycarbonyl groups, hydroxy groups, alkoxy groups, cyano groups, acyl groups, acyloxy groups, carbonyloxy ester groups, sulfonic acid ester groups, alkylthio groups, dialkylamino groups, carboxy groups, sulfo groups, phosphono groups, and any other group readily apparent to one skilled in the art. $R_1$, $R_2$, $R_3$, $R_4$ and $R_5$ can independently be alkyl groups.

Alternatively, $R_1$ and $R_3$ taken together, $R_2$ and $R_4$ taken together, $R_1$ and $R_2$ taken together, or $R_3$ and $R_4$ taken together, can form a substituted or unsubstituted 5- to 7-membered heterocyclic ring.

Where $R_1$ and $R_3$ are taken together or $R_2$ and $R_4$ are taken together, the heterocyclic rings can be saturated or unsaturated and can contain oxygen, nitrogen or sulfur atoms in addition to carbon atoms. Useful rings of this type include, but are not limited to, imidazole, pyrroline, pyrrolidine, thiohydantoin, pyridone, morpholine, piperazine and thiomorpholine rings. These rings can be substituted with one or more alkyl groups (having 1 to 5 carbon atoms), aryl groups (having 6 to 10 carbon atoms in the central ring system), cycloalkyl groups (having 5 to 10 carbon atoms in the central ring system), alkoxy groups, carbonyloxyester groups, halo groups, cyano groups, hydroxy groups, acyl groups, alkoxycarbonyl groups, sulfonic ester groups, alkylthio groups, carbonyl groups, carboxy groups, sulfo groups, phosphono groups, and other groups readily apparent to one skilled in the art.

Where $R_1$ and $R_2$ are taken together or $R_3$ and $R_4$ are taken together, the heterocyclic rings can be saturated or unsaturated and can contain oxygen, nitrogen or sulfur atoms in addition to carbon atoms. Useful rings of this type include, but are not limited to, 2-imidazolidinethione, 2-thioxo-1-imidazolidinone(thiohydantoin), 1,3-dihydro-2H-imidazole-2-thione, 1,3-dihydro-2H-benzimidazole-2-thione, tetrahydro-2,2-thioxo-5-pyrimidine, tetrahydro-1,3,5,-triazine-2(1H)-thione, dihydro-2-thioxo-4,6-(1H,3H)-pyrimidinedione, dihydro-1,3,5-triazine-2,4-(1H, 3H)-dione and hexahydro-diazepine-2-thione rings. These rings can be substituted with one or more alkyl groups (having 1 to 5 carbon atoms), aryl groups (having 6 to 10 carbon atoms in the central ring system), cycloalkyl groups (having 5 to 10 carbon atoms in the central ring system), carbonyloxyester groups, halo groups, cyano groups, hydroxy groups, acyl groups, alkoxycarbonyl groups, sulfonic ester groups, alkylthio groups, carbonyl groups, alkoxy groups, carboxy groups, sulfo groups, phosphono groups, and other groups readily apparent to one skilled in the art.

Preferably, $R_1$, $R_2$, $R_3$, and $R_4$ independently represent hydrogen, alkyl, alkenyl, alkynyl, aryl, and heterocyclic groups, more preferably hydrogen, alkyl, aryl, and alkenyl groups, and most preferably alkenyl groups. A preferred alkenyl group is an allyl group. A preferred alkyl group is a methyl group.

In Structure V noted above, $R_1$, $R_2$, $R_3$, $R_4$ and $R_5$ have the same definitions as noted above for $R_1$, $R_2$, $R_3$ and $R_4$ in Structure IV with the following differences:

$R_1$ and $R_3$ can be taken together, $R_2$ and $R_4$ can be taken together, $R_3$ and $R_5$ can be taken together and/or $R_4$ and $R_5$ can be taken together, to form substituted or unsubstituted 5- to 7-membered heterocyclic rings (as described above for Structure IV). When those heterocyclic rings are formed from $R_1$ and $R_3$ taken together or $R_2$ and $R_4$ taken together, they are as defined above for $R_1$ and $R_3$ taken together for Structure IV, but the resulting heterocyclic rings can have other substituents such as alkoxy groups, dialkylamino groups, and carboxy, sulfo, phosphono and other acidic groups. When those heterocyclic rings are formed from $R_3$ and $R_5$ taken together or $R_4$ and $R_5$ taken together, they can be substituted as described for $R_1$ and $R_3$ of Structure IV Useful rings of this type include, but are not limited to, 2-imidazolidinethione, 2-thioxo-1-imidazolidinone (thiohydantoin), 1,3-dihydro-2H-imidazole-2-thione, 1,3-dihydro-2H-benzimidazole-2-thione, tetrahydro-2,2-thioxo-5-pyrimidine, tetrahydro-1,3,5,-triazine-2(1H)-thione, dihydro-2-thioxo-4,6-(1H, 3H)-pyrimidinedione, dihydro-1,3,5-triazine-2,4-(1H, 3H)-dione and hexahydrodiazepine-2-thione rings.

For Structure V, the preferred groups for $R_1$–$R_5$ are hydrogen, alkyl, alkenyl, alkynyl, aryl, and heterocyclic groups, more preferably alkyl, aryl, and alkenyl groups, and more preferably alkenyl groups. A preferred alkenyl group is an allyl group.

Also in Structure V, most preferable alkyl groups are methyl and ethyl groups. Most preferable aryl groups are phenyl or tolyl groups. Most preferable cycloalkyl groups are cyclopentyl and cyclohexyl groups. Most preferably the alkenyl group is an allyl group. Most preferable heterocyclic groups are morpholino and piperazino groups.

In Structure VI noted above, $R_1$, $R_2$, $R_3$, $R_4$, $R_5$, and $R_6$ have the same definitions as noted above for $R_1$, $R_2$, $R_3$, $R_4$, and $R_5$ in Structure V described above. In addition, $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring as described above for the heterocyclic rings in Structure V.

$R_7$ is a divalent aliphatic or alicyclic linking group including but not limited to substituted or unsubstituted alkylene groups having 1 to 12 carbon atoms, substituted or unsubstituted cycloalkylene groups having 5 to 8 carbon atoms in the ring structure, substituted or unsubstituted arylene groups having 6 to 10 carbon atoms in the ring structure, substituted or unsubstituted divalent heterocyclyl groups having 5 to 10 carbon, nitrogen, oxygen, and sulfur atoms in the ring structure, or any combination of two or more of these divalent groups, or any two or more of these groups connected by ether, thioether, carbonyl, carbonamido, sulfoamido, amino, imido, thiocarbonyl, thioamido, sulfinyl, sulfonyl, or phosphinyl groups. Preferably, $R_7$ is a substituted or unsubstituted alkylene group having at least 2 carbon atoms.

Further details of these preferred thiourea ligands are provided in U.S. Pat. No. 6,368,779 (Lynch et al.) incorporated herein by reference. Most preferably, the thiourea compounds are substituted with the same aliphatic substituent.

Representative chemical sensitizers of Structure I, II, or III include, but are not limited to, the following compounds. It is to be understood that in coordination compounds, the exact chemical structures may not be known. The structures shown below are representative of the stoichiometries of the tellurium compounds.

I-1

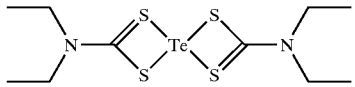

I-2

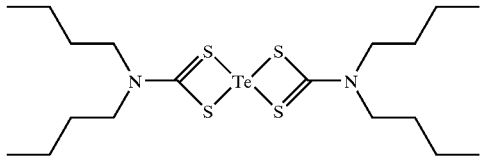

I-3

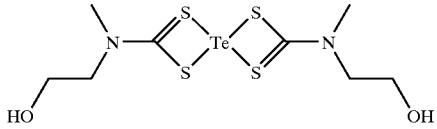

I-4

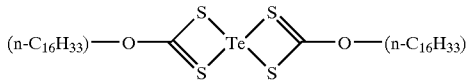

I-5

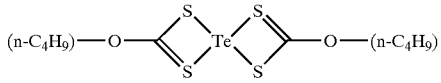

I-6

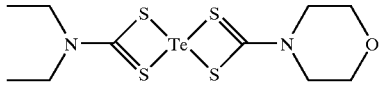

I-7

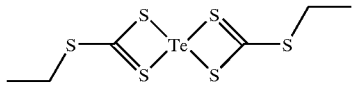

I-8

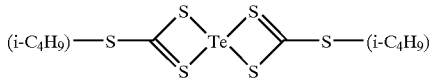

I-9

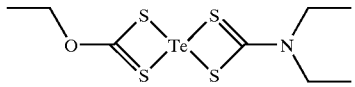

I-10

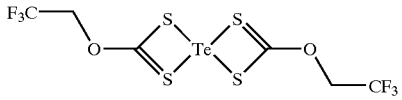

I-11

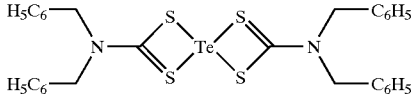

-continued
I-12
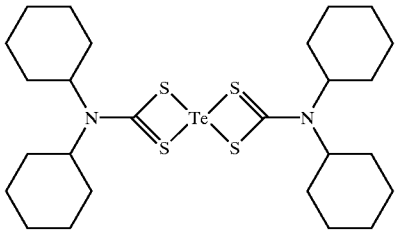
I-13
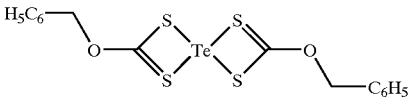
I-14
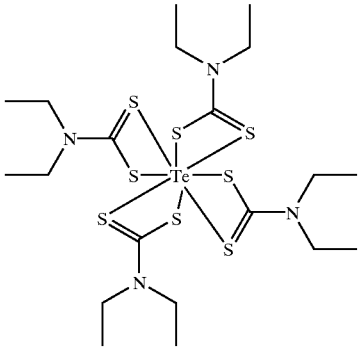
II-1
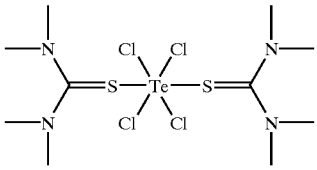
II-2
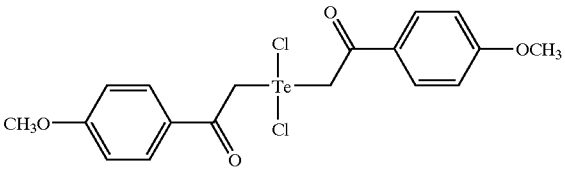
II-3
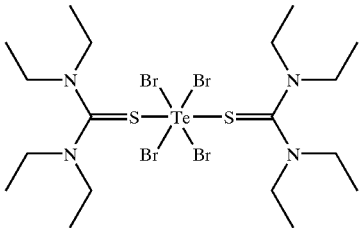
II-4
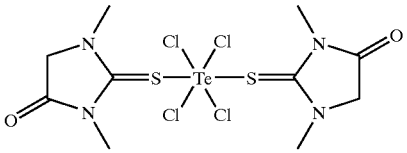
II-5
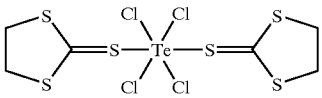
-continued
II-6
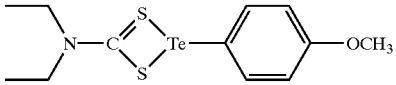
II-7
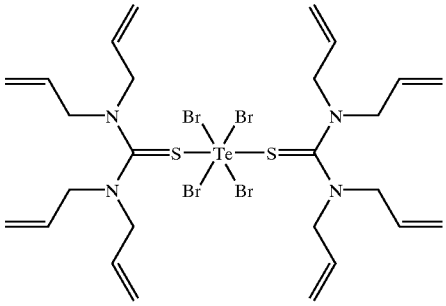
II-8
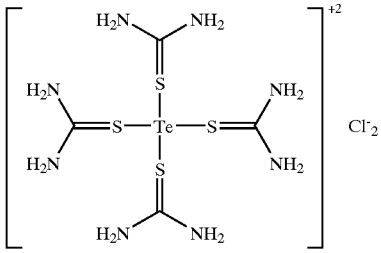
II-9
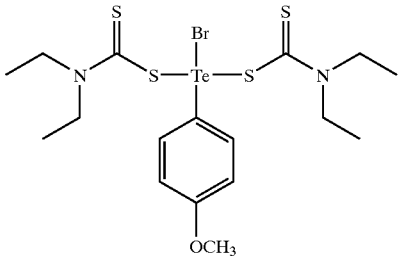
II-10
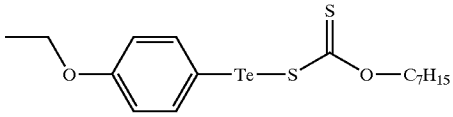
II-11
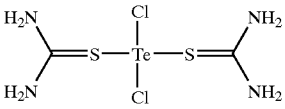
II-12
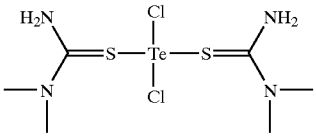
II-13
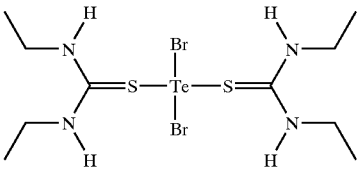

-continued

II-14

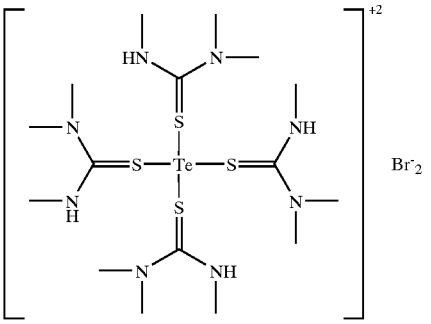

II-15

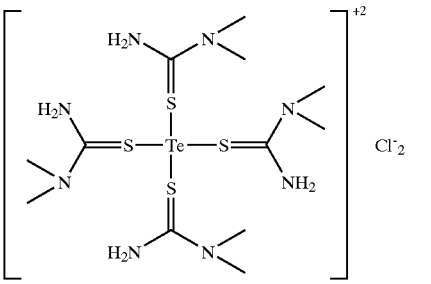

II-16

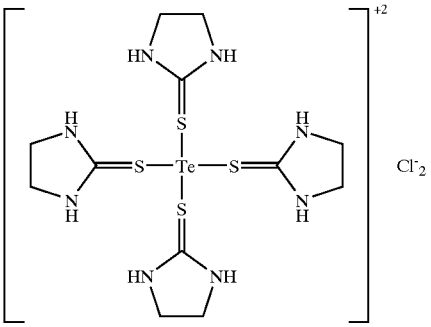

| | |
|---|---|
| $Te(phenyl)_2(S_2CO\text{-}ethyl)_2$ | II-17 |
| $Te(pyridyl)_2Br_2$ | II-18 |
| Te(phenyl)Br | II-19 |
| $Te(p\text{-}tolyl)(S_2CO\text{-}butyl)$ | II-20 |
| $Te(p\text{-}anisyl)[(S_2CN(ethyl)_2]_2Br$ | II-21 |
| $PdBr_2[Te(p\text{-}anisyl)_2]_2$ | III-1 |
| $PdCl_2[Te(mesityl)_2]_2$ | III-2 |
| $Pd(SCN)_2\{Te[CH_2Si(CH_3)_3]_2\}_2$ | III-3 |
| $Te(S_2P(O\text{-}ethyl)_2)_2$ | III-4 |
| $Te(S_2P(n\text{-}butyl)_2)_2$ | III-5 |
| $Te(S_2C\text{-}phenyl)_2$ | III-6 |
| $Te(S_2CS\text{-}i\text{-}propyl)_2$ | III-7 |
| $TeBr_4(pyridine)_2$ | III-8 |

The tellurium chemical sensitizers described herein by Structure I, II, or III can be used individually or in mixtures. They can be present in one or more imaging layer(s) on the front side of the photothermographic material. Preferably, they are in every layer that contains the photocatalyst (for example, photosensitive silver halide). The total amount of such compounds in the material will generally vary depending upon the average size of silver halide grains. The total amount is generally at least $10^{-7}$ mole per mole of total silver, and preferably from about $10^{-5}$ to about $10^{-2}$ mole per mole of total silver for silver halide grains having an average size of from about 0.01 to about 2 $\mu$m. The upper limit can vary depending upon the compound used, the level of silver halide and the average grain size, and it would be readily determinable by one of ordinary skill in the art.

The tellurium chemical sensitizers useful in the present invention can be prepared using readily available starting materials and known procedures as described for example, in K. J. Irgolic "*The Organic Chemistry of Tellurium*", *Gordon and Breach, NY,* 1974, K. J. Irgolic, "*Houben Weyl Methods of Organic Chemistry, Vol. E* 12*b, Organotellurium Compounds*", D. Klamann, Ed., Georg Thieme Verlag, Stuttgart, Germany, 1990*, Synthetic Method of Organometallic and Inorganic Chemistry*. W. A. Herrmann and C. Zybill, Eds., Georg Thieme Verlag, N. Y., 1997: Vol. 4, Chapter 3: K. J. Irgolic, Tellurium and its Compounds, *The Chemistry of Organic Selenium and Tellurium Compounds*, Vol. 1 (1986) and Vol. 2 (1987), S. Patai and Z. Rappoport, Eds, Wiley, New York, H. J. Gysling, H. R. Luss, and D. L. Smith, *Inorg. Chem.,* 18, 2696(1979), H. J. Gysling, M. Lelental, M. G. Mason, L. J. Gerenser, *J. Photogr. Sci.,* 30, 55(1982), S. Husebye, *Phosphorus Sulfur,* 38, 271–280 (1988), S. Husebye, *Phosphorus, Sulfur Silicon Relat. Elem.,* 136, 137 & 138, 377–395(1998), I. Haiduc, R. B. King, and M. G. Newton, *Chem. Rev.,* 94, 301–326(1994), S. Husebye and K. W. Tomoos, *Acta Crystallog.*, C56, 1242(2000), and S. Husebye and K. Maartmann-Moe, *Acta Chem. Scand,* 49, 834(1995).

Compound II-1, $[TeCl_4(tetramethylthiourea)_2]$, was prepared as described in O. Foss and W. Johannessen, *Acta Chem. Scand.,* 15, 1939(1961).

Compounds of Structure III $[M(X^2)_2[Te(R')_2]_2$, where M=Pd or Pt, X=Cl, Br, or SCN, R'=alkyl or aryl] were prepared by reaction of the appropriate $K_2[MX_4]$ complex with 2 equivalents of the diorganotelluride as described in H. J. Gysling, H. R. Luss, and D. L. Smith, *Inorg. Chem.,* 18, 2696(1979). Dialkyl and diaryl tellurides were prepared by the standard procedures given in, for example, K. J. Irgolic "*The Organic Chemistry of Tellurium*", Gordon and Breach, NY, 1974. Tellurium complexes of the type $Te(S_2CNR_2)_4$ were prepared by the procedure reported in W. Mazurek and A. G. Moritz, *Inorg. Chim. Acta,* 154, 71(1988) and G. St. Nikolov, N. Jordanov, and I. Havezov, *J. Inorg. Nucl. Chem.,* 33, 1055(1971).

A representative synthesis of a Te complex of the type $Te(S_2X)_2$ [that is, $Te(S_2CNEt_2)_2$] is provided in Synthetic Example 1 below.

Alternatively, the Te(2+) dithiocarbamate complexes useful in the practice of this invention can be prepared by an oxidation addition type reaction between elemental tellurium powder and the corresponding tetraorganothiuram disulfide [for example, $(R)_2NC(=S)S—SC(=S)N(R)_2$ wherein R is a substituted or unsubstituted alkyl group such as methyl, ethyl, n-butyl, and benzyl] at an elevated temperature, such as in refluxing toluene. Such a synthesis is illustrated below in Synthetic Example 2.

The tellurium-containing chemical sensitizers described herein can be added at one or more times during the preparation of the photothermographic emulsion formulations using any methods known in the art. For example, the compounds can be provided in an solution or an aqueous solid particulate dispersion as described for example in U.S.

Pat. No. 5,759,760 (Lushington et al.). After addition of the tellurium-containing compounds, it may be advantageous to heat the resulting dispersion up to 75° C. to promote the chemical sensitization process. It would be readily apparent to a skilled artisan using routine experimentation as to the optimum time for adding the tellurium-containing compound to achieve maximum speed enhancement in the photothermographic emulsion.

As noted above, the photothermographic emulsions useful to make the imaging materials of this invention can be prepared by:

A) providing a photothermographic emulsion comprising silver halide grains and an aqueous colloidal dispersion (such as a nanoparticulate dispersion) of a non-photosensitive source of reducible silver ions, and B) positioning one or more of the tellurium-containing chemical sensitizing compound represented by Structure I, II, or III described above on or around the silver halide grains, the tellurium-containing compounds being particularly provided in an aqueous solution or an aqueous solid particulate dispersion.

More particularly, such a method can comprise:

A) providing silver halide grains,

B) providing a photothermographic emulsion of the silver halide grains and an aqueous colloidal dispersion (such as a nanoparticulate dispersion) of a non-photosensitive source of reducible silver ions, and C) prior to, during, or immediately following either or both of steps A and B, chemically sensitizing the silver halide grains with a tellurium-containing chemical sensitizing compound represented by Structure I, II, or III described above, the tellurium-containing compounds being particularly provided in an aqueous solution or an aqueous solid particulate dispersion.

In some embodiments of this method, step C can follow step B. That is, chemical sensitization takes place after the mixing of the aqueous colloidal dispersion of a non-photosensitive source of reducible silver in the presence of the preformed silver halide grains.

Alternatively, step C can be carried out between steps A and B. In this instance, the preformed silver halide grains are chemically sensitized immediately before they are mixed with the aqueous colloidal dispersion of a non-photosensitive source of reducible silver ions.

Still further, step C can be carried out prior to step A by chemically sensitizing preformed silver halide grains before they are mixed with the aqueous colloidal dispersion of a non-photosensitive source of reducible silver ions or before the non-photosensitive source of reducible silver ions is formed in their presence.

In preferred embodiments of this invention, the tellurium-containing compounds are provided as a dispersion of solid particles in water. Such compounds are generally purified to a high level by methods well known in the art (such as recrystallization or various chromatographic techniques). The purified compound is then dissolved in water or milled to provide an aqueous solid particulate dispersion. The resulting solution or dispersion is then added to the silver halide emulsion which is then subjected to a "finishing" step in which it is heated up to 75° C. for up to 60 minutes.

Solid particle dispersions of the tellurium-containing compounds are prepared by milling an aqueous slurry (about 2% by weight) of the tellurium-containing compounds with a suitable surfactant (about 36% by weight relative to the weight of the tellurium-containing compound). Techniques for this process are well known in the art, being described for example by Patton, *Paint Flow and Pigment Dispersion, 2nd* Ed., Wiley Interscience, New York, 1979). The type of milling technique chosen should be capable of producing an end product in which the tellurium-containing compound particles are less than 1 μm in diameter. Milling devices are well known in the art (for example, a SWECO Vibro-Energy Mill available from SWECO Inc., Los Angeles, Calif.). Further details about milling in general are provided in *Research Disclosure*, Item 37018, February 1995.

In general, the milling device is charged with the solid tellurium-containing compound, surfactant, water, and milling media. The concentration of tellurium-containing compound should be from about 1 to about 20% by weight. The surfactant must be compatible with the imaging components in the photothermographic materials of this invention. One useful surfactant is TRITON® X-200 anionic surfactant available from Union Carbide Corporation. A weight ratio of surfactant to tellurium-containing compound is from about 0.001:1 to about 1:1. The milling media can be constructed of any conventional material such as glass, polymeric, metals, or ceramics of various sizes. Zirconium oxide is a preferred milling medium.

The aqueous slurry of components and milling media can be introduced into the milling device in any order, or pre-blended. Milling temperature can be varied but is usually ambient temperature, and the time for milling can usually be up to eight days.

Following milling, the slurry is separated from the milling media by coarse filtration. The resulting slurry can be used in this form or diluted with a hydrophilic colloid (such as gelatin) or polymer to form a solid particle dispersion. Alternatively, filtration can follow dilution. The preferred gelatin can be acid- or base-processed gelatin.

Particle size can be determined using light microscopy, and if large aggregates are present, they can be broken up using sonication.

As noted above, the tellurium-containing chemical sensitizing compounds can be added to the photothermographic emulsion at various stages of formation. They can be added as the sole chemical sensitizers or in combination with conventional chemical sensitizers described below. They can be added in combination with other desirable components such as antifoggants, the nanoparticulate dispersions of non-photosensitive reducible silver ions, stabilizers, or spectral sensitizing dyes.

Additional chemical sensitizers may be used in combination with the speed increasing tellurium compounds described above. Such compounds may contain sulfur or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Chapter 5, pages 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915,371 (Lok et al.).

In one embodiment, a second chemical sensitizer is used in combination with the tellurium chemical sensitizers described herein. Preferred, additional chemical sensitizers are thiourea compounds as represented by Structure IV, V or VI described above. Most preferred additional chemical sensitizers are the tetra substituted thiourea compounds represented by Structure IV and those described in U.S. Pat. No. 6,368,779 (noted above).

In general, it may also be desirable to add spectral sensitizing dyes to enhance silver halide sensitivity to ultraviolet, visible and infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.), and U.S. Pat. No. 5,541,054 (Miller et al.), U.S. Pat. No. 5,281,515 (Delprato et al.), and U.S. Pat. No. 5,314,795 (Helland et al.) are effective in the practice of the invention.

An appropriate amount of sensitizing dye added is generally about $10^{-10}$ to $10^{-1}$ mole, and preferably, about $10^{-7}$ to $10^{-2}$ mole per mole of silver halide.

To further control the properties of photothermographic materials, (for example, contrast, $D_{min}$, speed, or fog), it may be preferable to add one or more heteroaromatic mercapto compounds or heteroaromatic disulfide compounds of the formulae: Ar—S-M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings are also envisioned to be suitable. For example, heteroaromatic mercapto compounds are described as supersensitizers for infrared photothermographic materials in EP-A-0 559 228. (Philip Jr. et al.).

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

Non-Photosensitive Source of Reducible Silver Ions

The non-photosensitive source of reducible silver ions used in photothermographic materials of this invention can be any compound that contains reducible silver (1+) ions. Preferably, it is a silver salt that is comparatively stable to light and forms a silver image when heated to 50° C. or higher in the presence of an exposed photocatalyst (such as silver halide) and a reducing composition.

Silver salts of organic acids, particularly silver salts of long-chain carboxylic acids are preferred. The chains typically contain 8 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. At least silver behenate is used in the practice of this invention.

Preferred examples of the silver salts of aromatic carboxylic acid and other carboxylic acid group-containing compounds include, but are not limited to, silver benzoate, silver-substituted benzoates, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates having hydrocarbon chains incorporating ether or thioether linkages, or sterically hindered substitution in the α-(on a hydrocarbon group) or ortho-(on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described, for example, in U.S. Pat. No. 4,504,575 (Lee). Silver salts of sulfosuccinates are also useful as described for example, in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-amino-thiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described, for example, in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free fatty carboxylic acid and analyzing for about 22% silver, can be used. For opaque photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

The non-photosensitive source of reducible silver ions is provided in the form of an aqueous colloidal dispersion of silver salt particles (such as silver carboxylate particles). The silver salt particles in such dispersions generally have a weight average particle size of less than 2000 nm when measured by any useful technique such as sedimentation field flow fractionation, photon correlation spectroscopy, or disk centrifugation.

It is particularly preferred that the non-photosensitive source of reducible silver ions be provided in the form of an aqueous nanoparticulate dispersion of silver salt particles (such as silver carboxylate particles). The silver salt particles in such dispersions generally have a weight average particle size of less than 1000 nm when measured by any useful technique such as sedimentation field flow fractionation, photon correlation spectroscopy, or disk centrifugation.

Obtaining such small silver salt particles for the noted dispersions can be achieved using a variety of techniques described in the copending application in identified in the following paragraphs, but generally they are achieved by high speed milling using devices such as those manufactured by Morehouse-Cowles and Hochmeyer. The details for such milling are well known in the art.

Such dispersions also advantageously include a surface modifier so the silver salt can more readily be incorporated into aqueous-based photothermographic formulations. Useful surface modifiers include, but are not limited to, vinyl polymers having an amino moiety, such as polymers prepared from acrylamide, methacrylamide, or derivatives thereof, as described in U.S. Pat. No. 6,391,537 (Lelental et al.), incorporated herein by reference. A particularly useful surface modifier is a thiopolyacrylamide such as dodecylthiopolyacrylamide that can be prepared as described in the noted copending application using the teaching provided by Pavia et al., Makromoleculare Chemie, 193(9), 1992, pp. 2505–17.

Other useful surface modifiers are phosphoric acid esters, such as mixtures of mono- and diesters of orthophosphoric acid and hydroxy-terminated, oxyethylated long-chain alcohols or oxyethylated alkyl phenols as described for example in U.S. Paent 6.387.611 (Lelental et al.), incorporated herein by reference. Particularly useful phosphoric acid esters are commercially available from several manufacturers under the trademarks or tradenames EMPHOS™ (Witco Corp.), RHODAFAC (Rhone-Poulenc), T-MULZ® Hacros Organics), and TRYFAC (Henkel Corp./Emery Group).

Such dispersions contain smaller particles and narrower particle size distributions than dispersions that lack such surface modifiers. Particularly useful nanoparticulate dispersions are those comprising silver carboxylates such as silver salts of long chain fatty acids having from 8 to 30 carbon atoms, including, but not limited to, silver behenate, silver caprate, silver hydroxystearate, silver myristate, silver palmitate, and mixtures thereof. Silver behenate nanoparticulate dispersions are most preferred. These nanoparticulate dispersions can be used in combination with the conventional silver salts described above, including but not limited to, silver benzotriazole, silver imidazole, and silver benzoate.

The one or more non-photosensitive sources of reducible silver ions are preferably present in an amount of about 5% by weight to about 70% by weight, and more preferably, about 10% to about 50% by weight, based on the total dry weight of the emulsion layer. Stated another way, the amount of the sources of reducible silver ions is generally present in an amount of from about 0.001 to about 0.2 mol/m$^2$ of the dry photothermographic material, and preferably from about 0.01 to about 0.05 mol/m$^2$ of that material.

The total amount of silver (from all silver sources) in the photothermographic materials is generally at least 0.002 mol/m$^2$ and preferably from about 0.01 to about 0.05 mol/m$^2$.

The photocatalyst and the non-photosensitive source of reducible silver ions must be in catalytic proximity (that is, reactive association). "Catalytic proximity" or "reactive association" means that they should be in the same layer, or in adjacent layers. It is preferred that these reactive components be present in the same emulsion layer.

Reducing Agents

The reducing agent (or reducing agent composition comprising two or more components) for the source of reducible silver ions can be any material, preferably an organic material, that can reduce silver (I) ion to metallic silver generally upon heating the imagewise-exposed photothermographic material. Conventional photographic developers such as methyl gallate, polyhydroxybenzenes such as hydroquinone and substituted hydroquinones, hindered phenols, amidoximes, azines, catechols, pyrogallol, ascorbic acid (and derivatives thereof), hydroxylamine (and derivatives thereof), aminophenol developing agents, 3-pyrazolidones, hydroxytetronamide developing agents, reductone developing agents, sulfonamidophenol developing agents, phenylenediamine leuco dyes, and other materials readily apparent to one skilled in the art can be used in this manner as described for example, in U.S. Pat. No. 6,020,117 (Bauer et al.), incorporated herein by reference. Sulfonamidophenol developing agents, such as described in Belgian Patent Publication 802,519 can be especially useful in the practice of the present invention.

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes described below.

Hindered phenol reducing agents are preferred (alone or in combination with one or more co-developers). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl)methanes, bis(hydroxyphenyl)methanes, hindered phenols, and hindered naphthols each of which may be variously substituted. Representative binaphthols include, but are not limited to, compounds described in U.S. Pat. No. 3,094,417 (Workman) and U.S. Pat. No. 5,262,295 (Tanaka et al.), both incorporated herein by reference.

More specific alternative reducing agents that have been disclosed in dry silver systems include amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid, such as 2,2'-bis(hydroxymethyl)-propionyl-β-phenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidinohexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenyl-acetate and ethyl-α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1 4-dihydropyridine), bisphenols [such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol) and 2,2-bis(3,5-dimethyl-4-hydroxyphenyl)propane], ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described for example, in U.S. Pat. No. 3,074,809 (Owen), U.S. Pat. No. 3,094,417 (Workman), U.S. Pat. No. 3,080,254 (Grant, Jr.), and U.S. Pat. No. 3,887,417 (Klein et al.). Auxiliary reducing agents may also be useful as described in U.S. Pat. No. 5,981,151 (Leenders et al.).

Useful co-developer reducing agents can also be used as described for example, in U.S. Pat. No. 6,387,605 (Lynch et al.), incorporated herein by reference. Examples of these compounds include, but are not limited to, 2,5-dioxocyclopentane carboxaldehydes, 5-(hydroxymethylene)-2,2 dimethyl. 1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents noted above are incorporated herein by reference.

Yet another class of co-developers are substituted acrylonitrile compounds that can be represented by structure III as follows:

$$H(R')C{=}C(R)CN \qquad \text{(III)}$$

wherein R is a substituted or unsubstituted aryl group of 6 to 14 carbon atoms in the single or fused ring structure (such as phenyl, naphthyl, p-methylphenyl, p-chlorophenyl, 4-pyridinyl and o-nitrophenyl groups) or an electron withdrawing group (such as a halo atom, cyano group, carboxy group, ester group and phenylsulfonyl group). R' is a halo group (such as fluoro, chloro and bromo), hydroxy or metal salt thereof, a thiohydrocarbyl group, an oxyhydroxycarbyl group, or a substituted or unsubstituted 5- or 6-membered aromatic heterocyclic group having only carbon atoms and 1 to 4 nitrogen atoms in the central ring (with or without fused rings attached), and being attached through a non-quaternary ring nitrogen atom (such as pyridyl, furyl, diazolyl, triazolyl, pyrrolyl, tetrazolyl, benzotriazolyl, benzopyrrolyl and quinolinyl groups). Further details of these compounds and their preparation can be found in U.S. Pat. No. 5,635,339 (Murray) and U.S. Pat. No. 5,545,515 (Murray et al.), both incorporated herein by reference.

Examples of such compounds include, but are not limited to, the compounds identified as HET-01 and HBET-02 in U.S. Pat. No. 5,635,339 (noted above) and CN-01 through CN-13 in U.S. Pat. No. 5,545,515 (noted above). Particularly useful compounds of this type are (hydroxymethylene) cyanoacetates and their metal salts.

Various contrast enhancers can be used in some photothermographic materials with specific co-developers. Examples of useful contrast enhancers include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the above patents are incorporated herein by reference.

The reducing agent (or mixture thereof) described herein is generally present as 5 to 18% (dry weight) of the emulsion layer. In multilayer constructions, if the reducing agent is added to a layer other than an emulsion layer, slightly higher proportions may be more desirable, such as from about 9 to about 24 weight %. More specifically, the dry coating coverage for the reducing agent is from about 0.5 $g/m^2$ to about 2 $g/m^2$. Optimum concentrations of reducing agent will depend upon a number of factors including the particular silver salt used, the image that is desired, development conditions, coating conditions, and other factors readily apparent to one skilled in the art.

Other Addenda

The photothermographic materials of the invention can also contain other additives such as dopants, shelf-life stabilizers, toners, antifoggants, contrast enhancers, development accelerators, acutance dyes, charge-control agents, hardeners, lubricants, matting agents, post-processing stabilizers or stabilizer precursors, and other image-modifying agents as would be readily apparent to one skilled in the art that would be useful in aqueous-based formulations.

The photothermographic materials of the present invention can be further protected against the production of fog and can be stabilized against loss of sensitivity during storage. Antifoggants and stabilizers that can be used alone or in combination include thiazolium salts as described in U.S. Pat. No. 2,131,038 (Stand) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damshroder), and 2-(tribromomethylsulfonyl)quinoline compounds as described in U.S. Pat. No. 5,460,938 (Kirk et al.). Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

Other antifoggants are hydrobromic acid salts of heterocyclic compounds (such as pyridinium hydrobromide perbromide) as described, for example, in U.S. Pat. No. 5,028,523 (Skoug), compounds having —$SO_2CBr_3$ groups as described, for example, in U.S. Pat. No. 5,594,143 (Kirk et al.) and U.S. Pat. No. 5,374,514 (Kirk et al.), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in EP-A-0 600,589 (Philip, Jr. et al.) and EP-A-0 600,586 (Philip, Jr. et al.), and tribromomethylketones as described, for example, in EP-A-0 600,587 (Oliff et al.).

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (Agfa-Gevaert).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(amino-methyl)aryldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethyl-pyrazole), 1,8-(3,6-diazaoctane)bis(isothiuronium)trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidine-dione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate(III), rhodium bromide, rhodium nitrate, and potassium hexachlororhodate(III)], inorganic peroxides and persulfates (such as ammonium peroxydisulfate and hydrogen peroxide), benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-amino-pyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazines and phthalazine derivatives [such as those described in U.S. Pat. No. 6,146,822 (noted above), incorporated herein by reference] are particularly useful toners.

Binders

The photocatalyst (such as photosensitive silver halide), the non-photosensitive source of reducible silver ions, the reducing agent composition, and any other additives used in the present invention are generally added to one or more binders that are hydrophilic. Mixtures of binders can also be used. It is preferred that the binder be selected from predominantly hydrophilic materials (that is more than 70 weight % of total binder weight), such as, for example, natural and synthetic resins that are sufficiently polar to hold the other ingredients in solution or suspension, but minor portions of hydrophobic binders may also be present.

Examples of useful hydrophilic binders include, but are not limited to, various colloids used alone or in combination as vehicles and/or binders. The useful materials include both naturally occurring substances such as proteins, gelatin and gelatin-like derivatives (hardened or unhardened), starches, cellulosic materials such as cellulose acetate, cellulose acetate butyrate, hydroxymethyl cellulose, acrylamide/methacrylamide polymers, acrylic/methacrylic polymers polyvinyl pyrrolidones, polyvinyl acetates, polyvinyl alcohols, poly(silicic acid), polysaccharides (such as dextrans, gum arabic, and starch ethers), and hydroxy-containing polymers such as those described in U.S. Pat. No. 4,828,971 (Przezdziecki). Other synthetic polymeric compounds that can be used are dispersible vinyl compounds that are in latex form. Some of these materials may be crosslinked.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and Pioloform BS-18 or Pioloform BL-16 (Wacker Chemical Company).

Hardeners for various binders may be present if desired. Useful hardeners are well known and include diisocyanate compounds as described for example, in EP-0 600 586B1 and vinyl sulfone compounds as described in EP-0 600 589B1.

Where the proportions and activities of the photothermographic materials require a particular developing time and temperature, the binder(s) should be able to withstand those conditions. Generally, it is preferred that the binder not decompose or lose its structural integrity at 120° C. for 60 seconds. It is more preferred that it not decompose or lose its structural integrity at 177° C. for 60 seconds.

The hydrophilic polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included. In dry coating coverage, the hydrophilic binder is generally present in an amount of from about 5 to about 100 g/m$^2$.

Support Materials

The photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports (such as papers or reflective polymer films) may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is the most preferred support. Various support materials are described, for example, in *Research Disclosure*, August 1979, item 18431.

Opaque supports can also be used, such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Photothermographic Formulations

The formulation for the photothermographic emulsion layer(s) can be prepared by dissolving and/or dispersing the hydrophilic binder, the tellurium-sensitized photocatalyst (such as silver halide), the nanoparticulate dispersion of the non-photosensitive source of reducible silver ions, the reducing composition, and optional addenda in water in any suitable order. However, the order of addition of various components may be important to obtain optimum photographic speed, contrast, and image density.

Since some of the components are in particulate form, it is advisable to use various mixing techniques to make sure all components are effectively distributed throughout the formulation. Colloid mill mixers and dispersator mixers can be used for this purpose.

Photothermographic materials can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads, including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying the photothermographic materials to reduce what is known as the "woodgrain" effect, or uneven optical density. This effect can be reduced or eliminated by several means, including treatment of the support, adding matting agents to the topcoat, using acutance dyes in certain layers, or other procedures described in the noted publication.

The photothermographic materials can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in U.S. Pat. No. 5,547,821 (Melpolder et al.) and EP-A-0 678 776 (Melpolder et al.). Other antistatic agents are well known in the art.

The photothermographic materials can be constructed of one or more layers on a support. Single layer materials should contain the tellurium-sensitized photocatalyst, the nanoparticulate dispersion of a non-photosensitive source of reducible silver ions, the reducing composition, the binder, as well as optional materials such as toners, acutance dyes, coating aids and other adjuvants.

Two layer constructions comprising a single imaging layer coating containing all the ingredients and a protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Protective layers are generally transparent, non-photosensitive layers that are arranged over the imaging layer(s). The protective layer is not necessarily the outermost surface layer. Multiple protective layers can be used if desired. The protective layer(s) can include charge control or antistatic agents, matte agents (that is, glass, organic polymer, or inorganic particles), lubricants, and the various binders to hold the materials in the layer. Generally, aqueous-based protective layer formulations are desired and include one or more hydrophilic binders.

Useful protective layers (for front or back side of the material) are generally transparent and can include one or more polymers such as poly(silicic acid), water-soluble hydroxy-containing polymers as described in U.S. Pat. No. 4,741,992 (Przezdziecki) and U.S. Pat. No. 4,828,971 (Przezdziecki), poly(vinyl alcohol), acrylamide and methacrylamide polymers, crosslinked gelatin, mixtures of any of these, and other materials known in the art. Particularly useful protective layers are prepared from materials described in U.S. Pat. No. 5,310,640 (Markin et al.) and U.S. Pat. No. 5,547,821 (Melpolder et al.)

Layers to promote adhesion of one layer to another in photothermographic materials are also known, as described for example, in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example, in U.S. Pat. No. 5,928,857 (Geisler et al.), or by using various well known surface treatments such as corona discharge and plasma treatment.

Photothermographic formulations described can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers, described above, may be used. Such formulations are described in U.S. Pat. No. 5,355,405 (Ludemann et al.).

Mottle and other surface anomalies can be reduced in the materials of this invention by incorporation of a fluorinated polymer as described for example, in U.S. Pat. No. 5,532,121 (Yonkonski et al.) or by using particular drying techniques as described, for example, in U.S. Pat. No. 5,621,983 (Ludemann et al.).

While the first and second layers can be coated on one side of the film support, the method can also include forming on the opposing or backside of said polymeric support, one or more additional layers, including an antihalation layer, an antistatic layer, protective layer, or a layer containing a matting agent (such as silica), or a combination of such layers. It is also contemplated that the photothermographic materials of this invention can include emulsion layers on both sides of the support.

To promote image sharpness, photothermographic materials according to the present invention can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials of this invention contain an antihalation coating on the support opposite to the side on which the emulsion and topcoat layers are coated.

Dyes particularly useful as antihalation and acutance dyes include dihydroperimidine squaraine dyes having the nucleus represented by the following general structure:

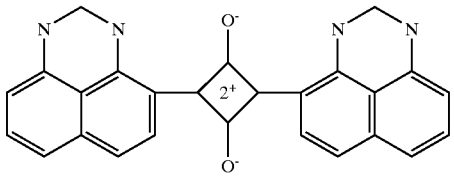

Details of such dyes having the dihydroperimidine squaraine nucleus and methods of their preparation can be found in U.S. Pat. No. 6,063,560 (Suzuki et al.) and U.S. Pat. No. 5,380,635 (Gomez et al.). These dyes can also be used as acutance dyes in frontside layers of the materials of this invention. One particularly useful dihydroperimidine squaraine dye is cyclobutenediylium, 1,3-bis[2,3-dihydro-2,2-bis [[1-oxohexyl)oxy]methyl]-1H-perimidin-4-yl]-2,4-dihydroxy-, bis(inner salt).

Dyes particularly useful as antihalation dyes in a backside layer of the photothermographic material also include indolenine cyanine dyes having the nucleus represented by the following general structure:

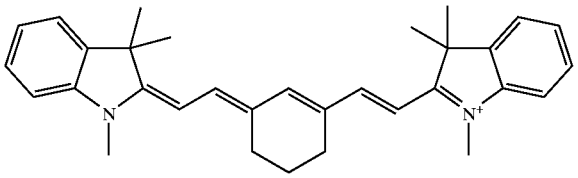

Details of such antihalation dyes having the indolenine cyanine nucleus and methods of their preparation can be found in EP-A-0 342 810 (Leichter), incorporated herein by reference. One particularly useful cyanine dye, compound (6) described therein, is 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate.

It is also useful in the present invention to employ acutance or antihalation dyes that will decolorize with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), and EP-A-0 911 693 (Sakurada et al.).

Imaging/Development

While the imaging materials of the present invention can be imaged in any suitable manner consistent with the type of material using any suitable imaging source (typically some type of radiation or electronic signal), the following discussion will be directed to the preferred imaging means. Generally, the materials are sensitive to radiation in the range of from about 300 to about 850 nm.

Imaging can be achieved by exposing the photothermographic materials to a suitable source of radiation to which they are sensitive, including X-radiation, ultraviolet light, visible light, near infrared radiation and infrared radiation to provide a latent image. Suitable exposure means are well known and include laser diodes that emit radiation in the desired region, photodiodes and others described in the art, including *Research Disclosure*, Vol. 389, September 1996, item 38957, (such as sunlight, xenon lamps and fluorescent lamps). Particularly useful exposure means includes gas lasers laser diodes, including laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

For using the materials of this invention, development conditions will vary, depending on the construction used but will typically involve heating the imagewise exposed material at a suitably elevated temperature. Thus, the latent image can be developed by heating the exposed material at a moderately elevated temperature of, for example, from about 50 to about 250° C. (preferably from about 80 to about 200° C. and more preferably from about 100 to about 200° C.) for a sufficient period of time, generally from about 1 to about 120 seconds (preferably from about 2 to about 30 seconds). Heating can be accomplished using any suitable heating means such as a hot plate, a steam iron, a hot roller or a heating bath. Development is usually carried out under ambient conditions for pressure and humidity.

In some methods, the development is carried out in two steps. Thermal development takes place at a higher temperature for a shorter time (for example, at about 150° C. for up to 10 seconds), followed by thermal diffusion at a lower temperature (for example, at about 80° C.) in the presence of a transfer solvent.

Use as a Photomask

The photothermographic materials of the present invention are sufficiently transmissive in the range of from about 350 to about 450 nm in non-imaged areas to allow their use in a process where there is a subsequent exposure of an ultraviolet or short wavelength visible radiation sensitive imageable medium. For example, imaging the photothermographic material and subsequent development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

One particularly useful embodiment of this invention is a photothermographic material comprising a transparent film support having thereon a photothermographic emulsion layer comprising a poly(vinyl alcohol) and in reactive association:

a. an aqueous dispersion of silver bromide or silver iodobromide (with up to 10 mol % silver iodide) grains and a peptizer, b. an aqueous nanoparticulate dispersion of a silver carboxylate or mixtures of carboxylates at least one of which is silver behenate, that comprises a surface modifier, c. a reducing composition for the reducible silver ions in the silver carboxylate(s) that includes a sulfonamidophenol reducing agent, the silver bromide or silver iodobromide grains being chemically sensitized with a tellurium-containing chemical sensitizing compound in an aqueous solid particulate dispersion, the tellurium-containing chemical sensitizing compound being represented by the following Structure I, II, or III:

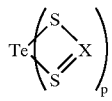

(I)

$$Te(L)_m(X^1)_n \quad \text{II}$$

$$Pd(X^2)_2[Te(R')_2]_2 \quad \text{III}$$

wherein X represents the same or different COR, CSR, $CN(R)_2$, CR, $P(R)_2$, or $P(OR)_2$ group, R is an alkyl, alkenyl, or aryl group, L is a ligand derived from a neutral Lewis base, $X^1$ and $X^2$ independently represent halo, OCN, SCN, $S_2CN(R)_2$, $S_2COR$, $S_2CSR$ $S_2P(OR)_2$, $S_2P(R)_2$, SeCN, TeCN, CN, SR, OR, $N_3$, alkyl, aryl, or $O_2CR$ groups, R' is an alkyl or aryl group, p is 2 or 4, m is 0, 1, 2, or 4, and n is 2 or 4 provided that when m is 0 or 2, n is 2 or 4, and when m is 1 or 4, n is 2.

The following examples are provided to illustrate the practice of this invention, and are not intended to be limiting in any manner. The examples provide exemplary synthetic procedures and preparatory procedures using the tellurium speed increasing compounds within the scope of the present invention.

MATERIALS AND METHODS FOR THE EXAMPLES

D-1

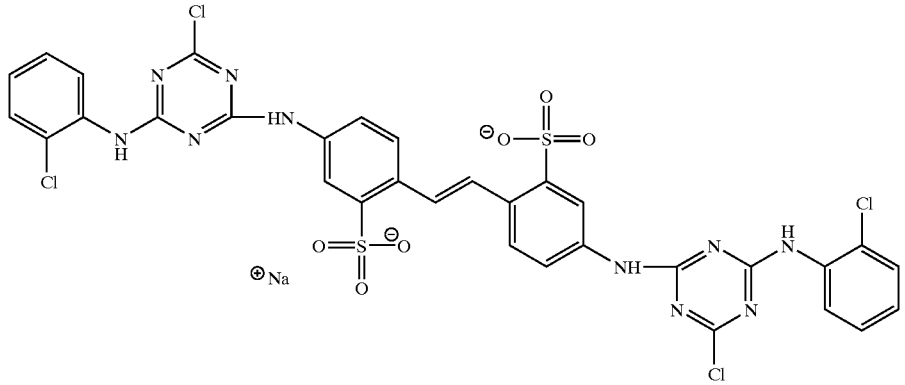

D2

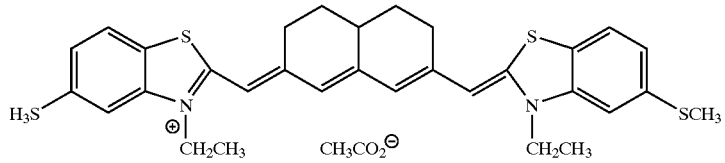

AF-1

AF-1

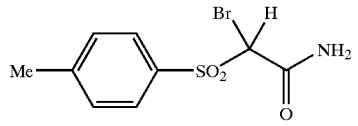

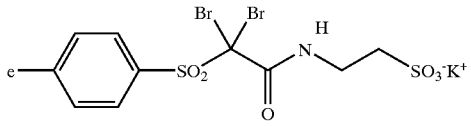

Dev-1

PVP

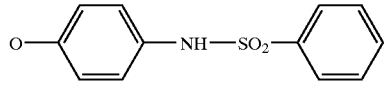

Developer
N-(4-hydroxyphenyl)-benzenesulfonamide

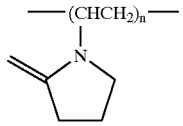

poly(vinyl pyrollidone MW~60,000)

SDS $H_3(CH_2)_{11}$—$SO_4^-Na^+$

SYNTHETIC EXAMPLES

The compound $TeCl_4$(tetramethylthiourea)$_2$ was prepared as described by Foss et al., *Acta Chem. Scand.* 15, p. 1939 (1961).

Compounds of Structure III $[M(X^2)_2[Te(R')_2]_2$, where M=Pd or Pt, X=Cl, Br, or SCN, R'=alkyl or aryl] were prepared by reaction of the appropriate $K_2[MX_4]$ complex with 2 equivalents of the diorganotelluride as described in Gysling et al., *Inorg. Chem.,* 18, p. 2696 (1979). Dialkyl and diaryl tellurides were prepared by the standard procedures given in, for example, Irgolic "*The Organic Chemistry of Tellurium*", Gordon and Breach, NY, 1974. Tellurium complexes of the type $Te(S_2CNR_2)_4$ were prepared by the procedure reported in Mazurek et al., *Inorg. Chim. Acta,* 154, p. 71 (1988) and St. Nikolov et al., *J. Inorg. Nucl. Chem.,* 33, p.1055 (1971).

A representative synthesis of a Te complex of the type $Te(S_2X)_2$ [for example $Te(S_2CNEt_2)_2$] is given in the following Synthetic Example 1.

Synthetic Example 1

Synthesis of $Te(S_2CNEt_2)_2$ From $TeO_2$ $TeO_2$ (1.6 g, 10 mmol) was dissolved, with heating, in a solution of 4 ml concentrated hydrochloric acid and 7 ml of glacial acetic acid. After complete dissolution of the solid, the resulting pale yellow solution was cooled to −5° C. in an ice-salt bath and a solution of 10 g of $Na_2S_2O_3 0.5H_2O$ in 5 ml of water was slowly added with stirring (keeping the solution temperature below −5° C.). After complete addition of the $Na_2S_2O_3$ solution, 25 ml more of the HCl-glacial acetic acid solution were added. To the resulting solution (T=−5° C.), in an ice salt bath, a solution of $NaS_2CNEt_2 0.3H_2O$ (5.63 g, 25 mmol) in 150 ml water was added dropwise. After complete addition of the sodium diethyldithiocarbamate solution, the resulting reaction solution was diluted to 1 liter with water, stirred 15 minutes more at room temperature, and filtered. The isolated orange precipitate was washed well with water and air dried to afford 4.18 g. The crude product was recrystallized from 30 ml of hot toluene to give, on cooling for 12 hours at −10° C., a crop of burgundy-red needles [3.7 g (87%)], m.p.=160° C.

Analysis: Calcd. (Found) for $C_{10}H_{20}N_2S_4Te$ (MW=424.14), C, 28.31(28.38), H, 4.75(4.51), N, 6.60 (6.59), S, 30.23 (29.94).

Synthetic Example 2

Synthesis of $Te(S_2CNEt_2)$ by Reaction of Tellurium Powder and Tetraethylthiuram Disulfide

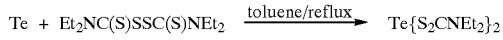

Method A:

Tellurium powder (3.2 g, 25 mm) and tetraethylthiuram disulfide (14.83 g., 50 mm) were suspended in 150 ml of toluene and the resulting suspension was refluxed for 48 hours, resulting in a deep red solution. The solution was then cooled overnight in a refrigerator, resulting in the deposition of a crop of large burgundy-red crystals, which were isolated by filtration and air dried (yield=7.65 g, 72.2% yield). Further concentration of the deep red filtrate from this crop of recrystallized material to 50 ml, followed by cooling, gave a second crop of red crystals (2.57 g). The total yield of product from this oxidative addition reaction was 10.22 g (96.4% yield).

Method B:

The above reaction was repeated using the same conditions, except that an equivalent amount of tetraethylthiuram disulfide was used (that is, 25 mm, 7.41 g). After refluxing for 48 hours, some unreacted tellurium powder remained in the reaction flask. The hot reaction solution was filtered to remove the unreacted tellurium, and cooling the filtrate overnight in a refrigerator gave a crop of burgundy red crystals which were isolated by filtration and air-dried (7.03 g). Concentration of the filtrate from the first crop of crystals to 20 ml and cooling the solution overnight in a refrigerator gave a $2^{nd}$ crop of burgundy red crystals (1.40 g) [total yield=8.43 g, 79.5% yield of $Te(S_2CNEt_2)_2$].

Method C:

The reaction described in method B above was repeated, except that the solution was refluxed for 10 hours and filtered to remove some unreacted tellurium powder. Cooling the deep red filtrate in a refrigerator overnight gave only a few red crystals so the solution was allowed to concentrate to 100 ml in a hood, resulting in a heavy crop of red crystals. Cooling this solution overnight in a refrigerator, followed by filtration of the precipitate gave 5.3 g of product (50% yield).

Synthetic Example 3

Synthesis of $Te(S_2CNEt_2)_2$ by Thermal Reduction of $Te(S_2CNEt_2)_4$

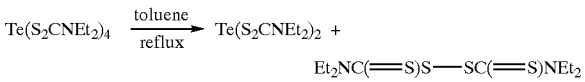

A solution of $Te(S_2CNEt_2)_4$ (30 g, 41.6 mmoles; *Ethyl Tellurac*™, Vanderbilt Chemical Co.), dissolved in 300 ml of toluene, was refluxed for 48 hours and the resulting deep red solution was cooled overnight in a refrigerator to give a crop of burgundy red crystals, which were isolated by filtration and air dried (7.03 g, 39.85% yield). The filtrate from the first crop of crystals was concentrated in a hood to 100 ml, resulting in the deposition of orange red solid. This suspension was then cooled overnight in a refrigerator and the precipitate was isolated by filtration and air-dried (4.3 g of an orange microcrystalline solid).

Synthetic Example 4

Synthesis of $Te(S_2CO\text{-}n\text{-}C_4H_9)_2$

Tellurium dioxide (1.6 g, 10 mmol) was dissolved, with heating, in 4 ml of concentrated HCl and 7 ml of glacial acetic acid to give a pale yellow solution. This solution was then cooled in an ice-salt bath and a solution of 10 g of sodium thiosulfate pentahydrate in 5 ml of water was added dropwise. After addition of all of the sodium thiosulfate solution, 25 ml more of the cold HCl-glacial acetic acid solution was added, keeping the solution temperature of about 0° C. To the resulting cold solution of $\{Te(S_2O_3)_2\}^{2-}$, a solution of $K\{S_2CO\text{-}n\text{-}C_4H_9\}$ (5.34 g, 25 mmole), dissolved in 150 ml of water, was added dropwise. After complete addition of this solution, the resulting suspension was diluted to 1 liter with water and further stirred at room temperature for 15 minutes. This solution was then cooled for a few hours, filtered, washed with cold water and air-dried (yield=4.05 g (theoretical yield=4.26 g, 95% yield). The gummy red solid became a purple-black color due to some decomposition to elemental tellurium on standing at room temperature. This crude product was then recrystallized from 200 ml of ethanol-toluene (3:2) at 60° C. The hot solution was immediately filtered, with the receiver flask immersed in an ice bath. A thin film of black tellurium was formed on the medium glass filter frit and large orange-red flakes deposited in the filtrate on cooling in a refrigerator overnight. The product was filtered and air dried to give a yield of 1.07 g red brown flakes [theoretical yield=4.26 g, 25.12% yield: Calcd. for $C_{10}H_{18}N_2O_2S_4Te$ (MW=426.10): C, 28.2 (28.2), H, 4.3 (4.8), S, 30.1 (30.0), Te, 29.9 (29.9), m.p.=45° C. (clear red melt, unchanged to about 90° C. when the melt becomes murky brown)].

Synthetic Example 5

Preparation of an Aqueous Solid Particle Dispersion of $Te(S_2CNEt_2)_2$

Into a 60-ml brown, glass bottle was placed 0.40 g of $Te(S_2CNEt_2)_2$, 2.12 g of a 6.8% solution of TRITON® X-200 anionic surfactant (Union Carbide) also containing 34 ml/liter 2N propionic acid, 22.81 g of distilled water, and 137 g of 2 mm zirconium oxide milling media. The bottle was capped and mounted on a SWECO mill and agitated for four days at room temperature. Following milling, the bottle and contents were warmed to 50° C. and added with good agitation to 14.70 g of a 16.80% solution of deionized, lime-processed, bone gelatin. This mixture was run through a coarse mesh sieve to separate the milling media. Nominal content of the final dispersion was 1.0% $Te(S_2CNEt_2)_2$ and 6.0% gelatin. Examination by light microscopy showed well-dispersed particles of average diameter less than 1 $\mu$m.

Example 1

Preparation of Photothermographic Emulsion: Sensitization of an Aqueous Silver Behenate/Silver Halide Dispersion Using an Aqueous Particle Dispersion of $Te(S_2CNEt_2)_2$ A) Preparation of an Aqueous Nanoparticulate Silver Behenate (AgBeh) Colloidal Dispersion Using Controlled Precipitation:

An example of the synthesis of the ML-41 oligomeric surfactant useful as the surface modifier in the invention is described below. The method for oligomerization was adapted from the preparation described by Pavia et al. *Makromoleculare Chemie,* 193(9), pp. 2505–17 (1992).

Synthesis of Dodecylthiopolyacrylamide (Type a, R=n-$C_{12}H_{25}$, X=Y=Z'=H, Average 10 Monomer Units)

Acrylamide (35.50 g, 0.50 moles) and 1-dodecanethiol (10.10 g, 0.050 moles) were suspended in ethanol (250 ml) under nitrogen atmosphere in a 1 liter three neck round bottomed flask equipped with a reflux condenser. The solution was stirred and degassed with nitrogen for 20 minutes. Stirring was continued and the temperature raised to 70° C. over a period of 20 minutes during which time the reagents dissolved. 2,2'-azo-bis(2-methylpropionitrile)[AIBN] (1.00 g, 6.10 mmoles) was added to the stirred solution at 70° C. and heating was continued for 4 hours under the control of an automated reactor system. During this time a white suspension formed. After cooling, the resulting white precipitate was filtered under suction and dried in vacuum to give a white powder (39.6 g, 87%). Analysis of this product was consistent with the desired oligomeric acrylamide.

Procedure for Precipitation of Nanoparticulate Silver Behenate:

An 18-liter reactor was charged with 9.97 kg of water, 363 g of an 18.16% aqueous solution of ML-41 surfactant, and 279.6 g of behenic acid. The contents were stirred at 150 RPM with an anchor stirrer and heated to 70° C. Once the mixture reached 70° C., 390.7 g of 10.85% aqueous potassium hydroxide were added to the reactor. The mixture was heated to 80° C. and held there for 30 minutes. The mixture was then cooled to 70° C. When the reactor reached 70° C., 1000 g of 12.77% aqueous silver nitrate were fed to the reactor in 5 minutes. After the addition, the nanoparticulate silver behenate was held at the reaction temperature for 30 minutes. It was then cooled to room temperature and decanted. A silver behenate dispersion with a median particle size of 160 nm was obtained.

Procedure for Purifying and Concentrating Nanoparticulate Silver Behenate Dispersions:

Twelve kg of a 3% solids nanoparticulate silver behenate dispersion were loaded into the hopper of a diafiltration/ultrafiltration apparatus. The permeator membrane cartridge was an Osmonics model 21-HZ20-S8J that had an effective surface area of 3.7 $ft^2$ (0.34 $m^2$) and a nominal molecular weight cutoff of 50,000. The pump was turned on and the apparatus was run so that the pressure going into the permeator was 50 psig (2585 Torr) and the pressure downstream from the permeator was 20 psig (1034 Torr). The permeate was replaced with deionized water until 24 kg of permeate had been removed from the dispersion. At this point, the replacement water was turned off and the apparatus was run until the dispersion had been concentrated to 28% solids. The yield was 886 grams.

Examples 2 and 3

Preparation of an Aqueous Photothermographic Material

A photothermographic emulsion layer was prepared by combining 161.1 grams of 6.3% aqueous solution of polyvinyl alcohol [PVA, Elvanol 52–22 86–89% hydrolyzed (DuPont)] with 109.4 g of an aqueous nanoparticulate silver behenate dispersion prepared as described above. To this mixture was added 9.51 g of solid particle dispersion of AF-1, 5.0 grams of a 25 g/l aqueous solution of AF-2, 2.50 g of succinimide and 6.07 g of a 50 g/l aqueous solution of sodium iodide. The mixture was stirred overnight. A primitive iodobromide cubic emulsion, Br9713, 48 nm in edge length and containing 20 g/silver mole of gelatin was melted at 40° C. and then chemically sensitized by combining 14.12 g of emulsion 0.757 kg/mol with 0.28 g of solid particle of $Te(S_2CNEt_2)_2$ described in Synthetic Example 5. The mixture was held at 40° C. for 20 minutes with good stirring. This mixture was spectrally sensitized at 40° C. by addition of 9.29 g of a 3 g/l aqueous solution of D-1 followed by addition of 1.51 g of a 7 g/l methanolic solution of D-2.

The silver behenate mixture described above (Example 2) was combined with 19.5 g of chemically and spectrally sensitized emulsion. This mixture was combined with 22.4 grams of a solid particle dispersion of developer Dev-1 (shown below). The solid particle dispersion of the developer had been prepared by milling a 20% solution of Dev-1, with 1.6% poly(vinyl pyrrolidone) and 0.8% sodium dodecyl sulfate in water. The solid particle dispersion of AF-1 had been prepared by milling a 20% solution of with 2.0% of TRITON® X-200 anionic surfactant (Union Carbide) in water.

A second photothermographic material (Example 3) was prepared at a higher level, 0.00109 $g/m^2$, of the chemical sensitizer $Te(S_2CNEt_2)_2$ A Control photothermographic material was prepared by omitting the $Te(S_2CNEt_2)_2$ chemical sensitizer.

The photothermographic materials were prepared by coating a gelatin subbed poly(ethylene terephthalate) support, having a thickness of 0.178 mm, with a photothermographic emulsion formulation and a protective overcoat formulation. The layers were coated using known coating procedures. The photothermographic emulsion formulations were coated from aqueous solution at a wet coverage of 106.5 $g/m^2$ to form imaging layers of the following dry composition

| Emulsion Components | Dry Coverage ($g/m^2$) |
|---|---|
| Succinimide | 0.761 |
| Dev-1 | 1.367 |
| Silver bromide grains (cubic edge 0.048 $\mu$m) | 0.472 |
| Silver level | |
| $Te(S_2CNEt_2)_2$ chemical stabilizer | 0.000652 |
| D-1 | 0.00652 |
| D-2 | 0.00196 |
| Silver behenate | 7.652 |
| Polyvinyl Alcohol (Elvanol 52-22 from DuPont, 86–89% hydrolyzed) | 3.260 |
| Sodium Iodide | 0.092 |
| AF-1 | 0.577 |
| AF-2 | 0.038 |

The resulting emulsion layer was then overcoated with mixture of polyvinyl alcohol and hydrolyzed tetraethyl orthosilicate as described below at a wet coverage of 40.4 $cc/m^2$ and dry coverage shown below.

| Overcoat Formulation Component | Grams |
|---|---|
| Distilled Water | 1158.85 g |
| Polyvinyl Alcohol (Elvanol 52-22 from DuPont, 86–89% hydrolyzed) (6.2% by weight in distilled water) | 763.43 |
| Tetraethyl Orthosilicate solution comprising of 178.5 g of water 1.363 g of p-toluene sulfonic acid, 199.816 g of methanol, 207.808 g of tetraethyl orthosilicate | 489.6 |
| Aerosol OT (0.15% by weight in distilled water. (sodium bis-2-ethylhexyl sulfosuccinate surfactant available from the Cytec Industries, Inc.) | 75.00 |
| ZONYL FSN (0.05% by weight in distilled water [mixture of fluoro-alkyl poly(ethyleneoxide) alcohols available from the DuPont Corp.] | 3.13 |
| Silica (1.5 $\mu$m average size) | 3.0 |

| Overcoat Component | Dry Coverage ($g/m^2$) |
|---|---|
| Silicate | 1.302 |
| Poly(vinyl alcohol) | 0.872 |
| Aerosol OT surfactant | 0.0624 |
| ZONYL FSN surfactant | 0.0207 |

The photothermographic materials were imagewise exposed using the 810 nm, laser sensitometer and heat processed at 122° C. for 15 seconds to produce a developed silver image. The sensitometric results are shown in TABLE I below.

TABLE I

| | Te compound (mmol/Ag mol) | Dmin (density) | Speed 1.0* (logE) | Speed 2.0* (logE) | Speed 3.0* (logE) | UDP** (density) |
|---|---|---|---|---|---|---|
| Control | 0 | 0.15 | 0.84 | 0.54 | 0.08 | 3.48 |
| Example 2 | 0.35 | 0.17 | 1.09 | 0.76 | 0.26 | 3.61 |
| Example 3 | 0.58 | 0.26 | 1.17 | 0.84 | 0.34 | 3.74 |

*Relative speed in log E above $D_{min}$
**Upper density point

The invention has been described in detail with particular reference to certain preferred embodiments thereof, but it will be understood that variations and modifications can be effected within the spirit and scope of the invention.

We claim:

1. An aqueous-based photothermographic material that is sensitive to infrared radiation and comprises a support having thereon one or more aqueous-based imaging layers comprising a hydrophilic binder and in reactive association:

a. a photocatalyst, b. a non-photosensitive source of reducible silver ions that is present as an aqueous colloidal dispersion, c. a reducing composition for said reducible silver ions, and d. a tellurium-containing chemical sensitizing compound represented by the following Structure I, II, or III:

(I)

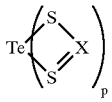

wherein X represents the same or different COR, CSR, CNRRa, CR, PRRa, or $P(OR)_2$ groups, R and Ra are independently alkyl, alkenyl, or aryl groups, L is a ligand derived from a neutral Lewis base, $X^1$ and $X^2$ independently represent a halo, OCN, SCN, $S_2CNRR_a$, $S_2COR$, $S_2CSR$ $S_2P(OR)_2$, $S_2PRR_a$, SeCN, TeCN, CN, SR, OR, alkyl, aryl, $N_3$, or $O_2CR$ group, R' is an alkyl or aryl group, p is 2 or 4, m is 0, 1, 2, or 4, and n is 2 or 4 provided that when m is 0 or 2, n is 2 or 4 and when m is 1 or 4, n is 2.

2. The photothermographic material of claim 1 wherein said non-photosensitive source of reducible silver ions is present as an aqueous colloidal dispersion of one or more silver carboxylates.

3. The photothermographic material of claim 1 wherein said colloidal dispersion is a nanoparticulate dispersion comprising particles of one or more silver carboxylates, the surface of which are modified with a surface modifier.

4. The photothermographic material of claim 3 wherein said surface modifier is either a thiopolyacrylamide or a phosphoric acid ester.

5. The photothermographic material of claim 2 wherein said non-photosensitive source of reducible silver ions is present as an aqueous nanoparticulate dispersion of a silver salt of a fatty acid having from 8 to 30 carbon atoms, or a mixture of said silver salts.

6. The photothermographic material of claim 1 wherein said tellurium-containing chemical sensitizing compound is present in said material in an amount of at least $1\times10^{-7}$ mole per mole of total silver and total silver present in said material is at least 0.002 mol/$m^2$.

7. The photothermographic material of claim 6 wherein said tellurium-containing chemical sensitizing compound is present in said material in an amount of from about $1\times10^{-5}$ to about 0.01 mole per mole of total silver, and is provided in an aqueous solution or an aqueous solid particle dispersion.

8. The photothermographic material of claim 1 wherein L is derived from thiourea, a substituted thiourea, pyridine, or a substituted pyridine.

9. The photothermographic material of claim 1 wherein said tellurium-containing chemical sensitizing compound is represented by Structure II and L is the same or different thiourea ligand derived from a compound represented by the following Structure IV, V, or VI:

(IV)

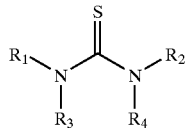

(V)

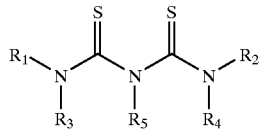

(VI)

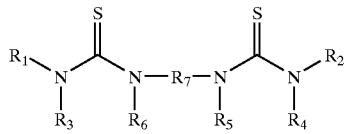

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure Vl, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and R7 is a divalent aliphatic or alicyclic linking group.

10. The photothermographic material of claim 1 wherein $X^1$ is a halo, SCN, or $S_2CNRR_a$ group.

11. The photothermographic material of claim 10 wherein $X^1$ is chloro or bromo.

12. The photothermographic material of claim 1 wherein said tellurium-containing chemical sensitizing compound is represented by Structure II, m is 2, and n is 4.

13. The photothermographic material of claim 1 wherein said tellurium-containing chemical sensitizing compound is represented by Structure I wherein p is 2 and X represents the same or different COR, CSR, $PRR_a$, $P(OR)_2$, or $CNRR_a$ groups wherein R and $R_a$ are independently substituted or unsubstituted alkyl groups.

14. The photothermographic material of claim 13 wherein X represents the same or different $CNRR_a$ groups.

15. The photothermographic material of claim 1 wherein said tellurium-containing chemical sensitizing compound is represented by Structure III wherein $X^2$ a halo, SCN, or SeCN group.

16. The photothermographic material of claim 15 wherein R' is a substituted or unsubstituted alkyl group having from 1 to 10 carbon atoms.

17. The photothermographic material of claim 1 wherein said tellurium-containing chemical sensitizing compound is selected from the following group of compounds:

(I-1)

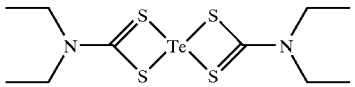

(I-2)

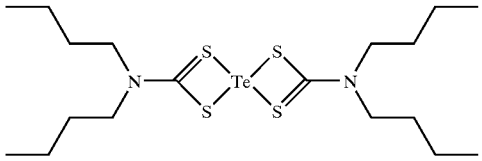

(I-3)

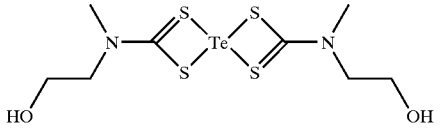

(I-4)

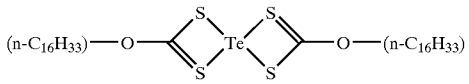

(I-5)

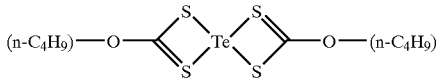

(I-6)

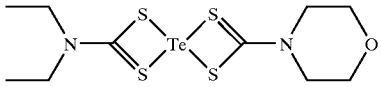

(I-7)

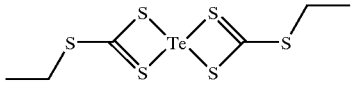

(I-8)

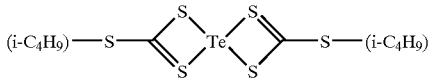

(I-9)

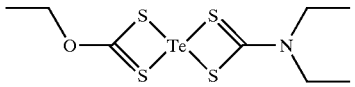

(_10)

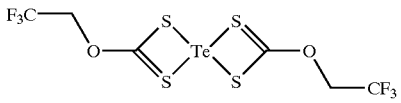

(I-11)

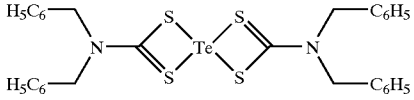

-continued (I-12)

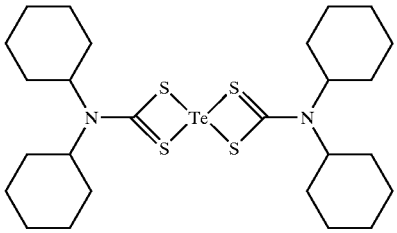

(I-13)

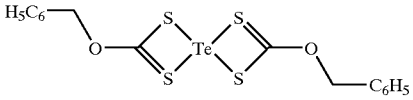

(I-14)

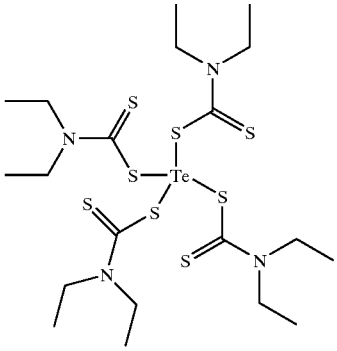

(II-1)

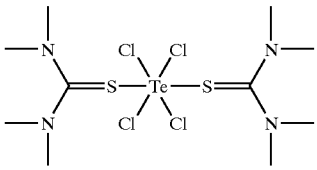

(II-2)

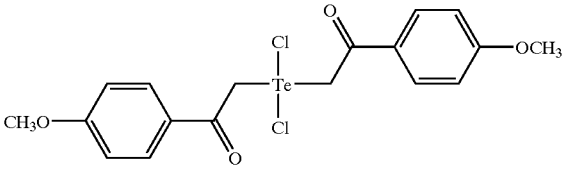

(II-3)

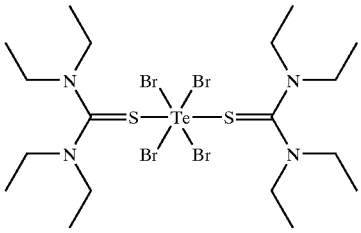

(II-4)

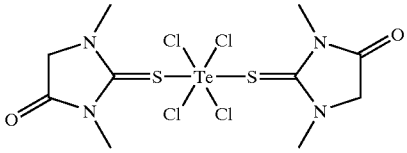

(II-5)

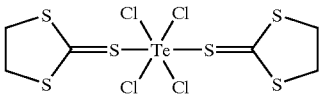

-continued (II-6)

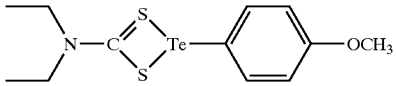

(II-7)

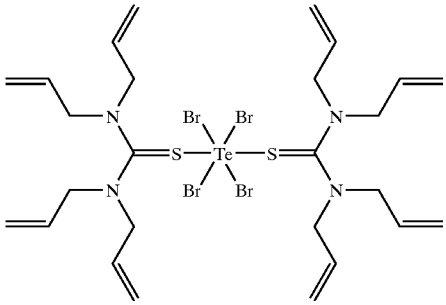

(II-8)

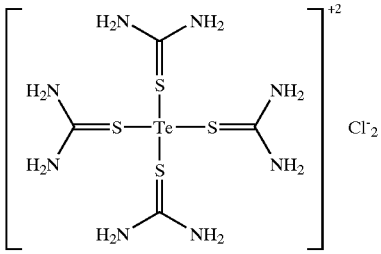

(II-9)

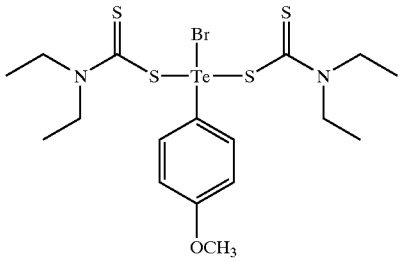

(II-10)

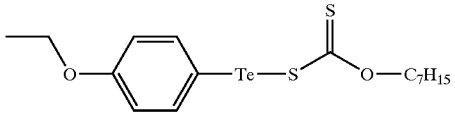

(II-11)

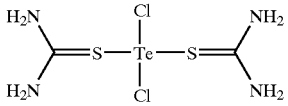

(II-12)

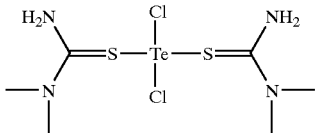

(II-13)

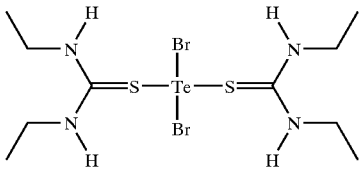

-continued (II-14)

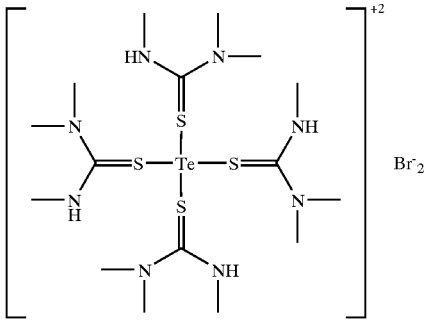

(II-15)

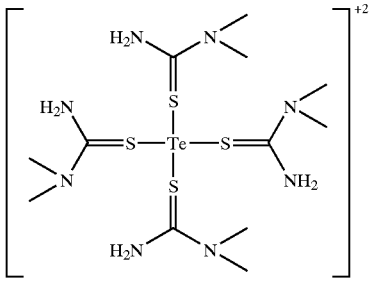

(II-16)

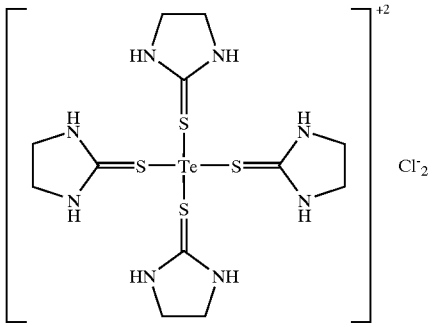

| | |
|---|---|
| $Te(phenyl)_2(S_2CO\text{-}ethyl)_2$ | (II-17) |
| $Te(pyridyl)_2Br_2$ | (II-18) |
| Te(phenyl)Br | (II-19) |
| $Te(p\text{-}tolyl)(S_2CO\text{-}butyl)$ | (II-20) |
| $Te(p\text{-}anisyl)[S_2CN(ethyl)_2]_2Br$ | (II-21) |
| $PdBr_2[Te(P\text{-}anisyl)_2]_2$ | (III-1) |
| $PdCl_2[Te(mesityl)_2]_2$ | (III-2) |
| $Pd(SCN)_2\ \{Te[CH_2Si(CH_3)_3]_2\}_2$ | (III-3) |
| $Te(S_2P(O\text{-}ethyl)_2)_2$ | (III-4) |
| $Te(S_2P(n\text{-}butyl)_2)_2$ | (III-5) |
| $Te(S_2C\text{-}phenyl)_2$ | (III-6) |
| $Te(S_2CS\text{-}i\text{-}propyl)_2$ | (III-7) |
| $TeBr_4(pyridine)_2$ | (III-8). |

18. The photothermographic material of claim 1 wherein said photocatalyst is a silver halide or a mixture of silver halides.

19. The photothermographic material of claim 18 wherein said photocatalyst includes silver bromide, silver iodobromide, or a mixture of both.

20. The photothermographic material of claim 1 wherein additional chemical sensitization is achieved by oxidative decomposition of a spectral sensitizing dye.

21. The photothermographic material of claim 1 further including a co-developer.

22. The photothermographic material of claim 21 further including a contrast enhancing agent.

23. The photothermographic material of claim 1 further comprising a heteroaromatic mercapto compound in an amount of at least 0.0001 mole per mole of total silver.

24. The photothermographic material of claim 23 wherein said heteroaromatic mercapto compound is 2-mercaptobenzimidazole, 2-mercapto-5-methylbenzimidazole, 2-mercaptobenzothiazole, 2-mercapto-benzoxazole, or a mixture of two or more of these compounds.

25. A method of this invention for forming a visible image comprising:

A) imagewise exposing the photothermographic material of claim 1 to near infrared radiation to form a latent image, and B) simultaneously or sequentially, heating said exposed photothermographic material to develop said latent image into a visible image.

26. The method of claim 25 wherein said photothermographic material support is transparent, and said method further comprises:

C) positioning said exposed and heat-developed photothermographic material with a visible image therein between a source of imaging radiation and an imageable material that is sensitive to said imaging radiation, and D) thereafter exposing said imageable material to said imaging radiation through said visible image in said exposed and heat-developed photothermographic material to provide a visible image in said imageable material.

27. The method of claim 26 wherein said imageable material is a photopolymer, a diazo material, a photoresist, or a photosensitive printing plate.

28. An aqueous-based photothermographic material that is sensitive to near infrared or infrared radiation and comprises a transparent support having on one side thereof, one or more aqueous-based photothermographic emulsion layers comprising:

a. silver bromide or silver iodobromide present in an amount of from about 0.005 to about 0.5 mole per mole of a non-photosensitive source of reducible silver ions, b. a non-photosensitive source of reducible silver ions that is a nanoparticulate dispersion of one or more silver carboxylates of fatty acids having from 10 to 30 carbon atoms, said one or more silver carboxylates being present in an amount of from about 10 to about 50 weight % of the total dry weight of said emulsion layer(s), the surface of said carboxylates being modified with a surface modifier that is either a vinyl polymer comprising an amido function or a phosphoric acid ester, c. one or more hindered phenol reducing agents, d. one or more hydrophilic binders, e. a heteroaromatic mercapto compound, and f. one or more tellurium-containing chemical sensitizing compounds that are represented by the following Structure I, II, or III:

(I)

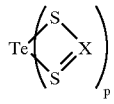

$$Te(L)_m(X^1)_n \quad \text{(II)}$$

$$Pd(X^2)_2[Te(R')_2]_2 \quad \text{(III)}$$

wherein X represents the same or different COR, CSR, or $CNRR_a$ groups, R and $R_a$ are independently alkyl groups, L is a ligand derived from a thiourea as represented in Structure IV, V, or VI below, $X^1$ and $X^2$ independently represent a chloro, bromo, or SCN group, m is 2, n is 4, and p is 2, (IV)

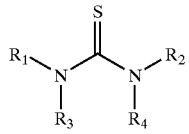

(V)

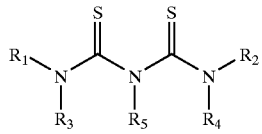

(VI)

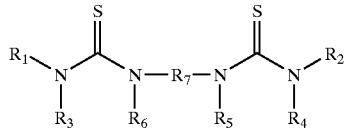

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and R3 taken together or $R_2$ and $R_4$ taken together, can form a $_5$- to $_7$-membered heterocyclic ring, in Structure V, $R_1$, $R_2$, $R_3$ , $R_4$ and R5 are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$ , $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group, said tellurium chemical sensitizer represented by Structure I, II, or III being present in said material in an amount of from about $1\times10^{-5}$ to about 0.01 mole per mole of total silver.

29. The photothermographic material of claim 28 further comprising a dihydroperimidine squaraine dye having a nucleus represented by the following structure:

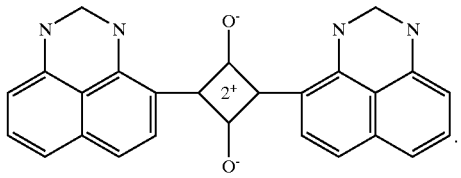

30. A method of this invention for forming a visible image comprising:

A) imagewise exposing the photothermographic material of claim 28 to infrared radiation to form a latent image, and B) simultaneously or sequentially, heating said exposed photothermographic material to develop said latent image into a visible image.

31. A method for preparing an aqueous-based photothermographic emulsion comprising:

A) providing a photothermographic emulsion that is sensitive to infrared radiation and comprising silver halide grains and an aqueous colloidal dispersion of a non-photosensitive source of reducible silver ions, and B) positioning one or more of tellurium-containing chemical sensitizing compounds represented by Structure I, II, or III shown below on or around said silver halide grains, said tellurium-containing chemical sensitizing compounds being provided in an aqueous solution or in an aqueous solid particulate dispersion, (I)

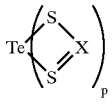

$$Te(L)_m(X^1)_n \quad \text{(II)}$$

$$Pd(X^2)_2[Te(R')_2]_2 \quad \text{(III)}$$

wherein X represents the same or different COR, CSR, $CNRR_a$, CR, $PRR_a$, or $P(OR)_2$ groups, R and $R_a$ are independently alkyl, alkenyl, or aryl groups, L is a ligand derived from a neutral Lewis base, $X^1$ and $X^2$ independently represent a halo, OCN, SCN, $S_2CNRR_a$, $S_2COR$, $S_2CSR$ $S_2P(OR)_2$, $S_2PRR_a$, SeCN, TeCN, CN, SR, OR, alkyl, aryl, $N_3$, or $O_2CR$ group, R' is an alkyl or aryl group, p is 2 or 4, m is 0, 1, 2, or 4, n is 2, or 4 provided that when m is 0 or 2, n is 2 or 4, and when m is 1 or 4, n is 2.

32. A method of preparing an aqueous-based photothermographic emulsion comprising:

A) providing silver halide grains that are sensitive to infrared radiation,

B) providing a photothermographic emulsion of said silver halide grains and an aqueous colloidal dispersion of a non-photosensitive source of reducible silver ions, and C) prior to, during, or immediately following either or both of steps A and B, chemically sensitizing said silver halide grains with one or more tellurium-containing chemical sensitizing compounds represented by Structure I, II, or III shown below, said tellurium-containing chemical sensitizing compounds being provided in an aqueous solution or in an aqueous solid particulate dispersion, (I)

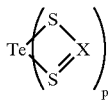

$$Te(L)_m(X^1)_n \quad \text{(II)}$$

$$Pd(X^2)_2[Te(R')_2]_2 \quad \text{(III)}$$

wherein X represents the same or different COR, CSR, $CNRR_a$, CR, $PRR_a$, or $P(OR)_2$ groups, R and $R_a$ are independently alkyl, alkenyl, or aryl groups, L is a ligand derived from a neutral Lewis base, $X^1$ and $X^2$ independently represent a halo, OCN, SCN, $S_2CNRR_a$, $S_2COR$, $S_2CSR$ $S_2P(OR)_2$, $S_2PRR_a$, SeCN, TeCN, CN, SR, OR, alkyl, aryl, $N_3$, or $O_2CR$ group, R' is an alkyl or aryl group, p is 2 or 4, m is 0, 1, 2, or 4, and n is 2 or 4, provided that when m is 0 or 2, n is 2 or 4, and when m is 1 or 4, n is 2.

33. The method of claim 32 wherein said tellurium-containing chemical sensitizing compound is added in an amount of from about $1\times10^{-8}$ to about $1\times10^{-2}$ mol/mol of silver in said silver halide grains.

34. The method of claim 32 wherein said tellurium-containing chemical sensitizing compounds are provided as particles having less than 1 $\mu$m average diameter.

35. The method of claim 32 wherein said aqueous solid particulate dispersion comprises said one or more tellurium-containing chemical sensitizing compounds in an aqueous dispersion of gelatin and a surfactant.

36. The method of claim 32 wherein said aqueous colloidal dispersion of said non-photosensitive source of reducible silver ions comprises a nanoparticulate dispersion of said particles of one or more silver carboxylates, the surface of which is modified with a surface modifier.

37. The method of claim 36 wherein said surface modifier is either a thiopolyacrylamide or a phosphoric acid ester.

* * * * *

UNITED STATES PATENT AND TRADEMARK OFFICE

CERTIFICATE OF CORRECTION

PATENT NO. : 6,733,959 B2
DATED : May 11, 2004
INVENTOR(S) : Henry J. Gysling et al.

It is certified that error appears in the above-identified patent and that said Letters Patent is hereby corrected as shown below:

Column 43,
Line 40, Claim 1 (d), should include structures II and III as follows:

$$Te(L)_m(X^1)_n$$
II $$Pd(X^2)_2[Te(R')_2]_2$$
III

Column 44,
Line 57, after "and" delete "R7" and insert -- $R_7$ --

Column 45,
Line 15, "after "$X^{2}$" insert -- is --

Column 50,
Line 43, after "and" delete "R3" and insert -- $R_3$ --
Line 44, after "and" delete "$_{5-}$ to $_{7-}$" and insert -- 5- to 7- --
Line 46, after "and" delete "R5" and insert -- $R_5$ --

Signed and Sealed this

Fourteenth Day of September, 2004

JON W. DUDAS
*Director of the United States Patent and Trademark Office*